US008109105B2

(12) United States Patent
Unezaki et al.

(10) Patent No.: US 8,109,105 B2
(45) Date of Patent: Feb. 7, 2012

(54) REFRIGERATING AIR CONDITIONING SYSTEM, METHOD OF CONTROLLING OPERATION OF REFRIGERATING AIR CONDITIONING SYSTEM, AND METHOD OF CONTROLLING AMOUNT OF REFRIGERANT IN REFRIGERATING AIR CONDITIONING SYSTEM

(75) Inventors: Fumitake Unezaki, Tokyo (JP); Tetsuji Saikusa, Tokyo (JP); Takashi Okazaki, Tokyo (JP); Makoto Saitou, Tokyo (JP); Hirokuni Shiba, Tokyo (JP); Sou Nomoto, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 942 days.

(21) Appl. No.: 11/665,008

(22) PCT Filed: Oct. 7, 2005

(86) PCT No.: PCT/JP2005/018619
§ 371 (c)(1),
(2), (4) Date: Apr. 10, 2007

(87) PCT Pub. No.: WO2006/057111

PCT Pub. Date: Jun. 1, 2006

(65) Prior Publication Data

US 2009/0013700 A1 Jan. 15, 2009

(30) Foreign Application Priority Data

Nov. 29, 2004 (JP) ..... 2004-343860

(51) Int. Cl.
*F25B 45/00* (2006.01)

(52) U.S. Cl. ..... 62/149; 62/77; 62/129; 62/160; 62/222; 62/225; 62/228.5; 62/324.1; 62/509

(58) Field of Classification Search ..... 62/129, 62/149, 160, 225, 228.5, 324.4, 77, 174, 62/222, 509

See application file for complete search history.

(56) References Cited

U.S. PATENT DOCUMENTS 4,467,613 A * 8/1984 Behr et al. ..... 62/115

(Continued)

FOREIGN PATENT DOCUMENTS

EP 1 059 495 12/2000

(Continued)

OTHER PUBLICATIONS

Office Action in CN 200580040433.9 dated Oct. 24, 2008 with English Summary.

(Continued)

*Primary Examiner* — Frantz Jules
*Assistant Examiner* — Azim Rahim
(74) *Attorney, Agent, or Firm* — Buchanan Ingersoll & Rooney PC

(57) ABSTRACT

In a refrigerating air conditioning system using refrigerant such as $CO_2$ used in a supercritical area, a highly efficient refrigerating air conditioning system is provided by adjusting the amount of refrigerant in a radiator which contributes to the efficiency of the system stably and quickly. During heat utilizing operation, the superheat at the exit of an evaporator is controlled to a predetermined value by controlling the opening of an expansion valve provided on the upstream side of the evaporator, and an expansion valve is controlled so that the state of refrigerant in a connection pipe on the high-pressure side becomes a supercritical state. In this state, a flow rate control valve is controlled to change the density of the refrigerant stored in a refrigerant storage container and the amount of refrigerant existing in the radiator is adjusted. A target high-pressure value and a target value of the radiator exit temperature are set and the capacity of the compressor is controlled to obtain the target values, and the amount of refrigerant existing in the radiator is adjusted by the refrigerant amount adjusting circuit.

24 Claims, 11 Drawing Sheets

U.S. PATENT DOCUMENTS

| | | | | | |
|---|---|---|---|---|---|
| 4,841,739 | A * | 6/1989 | Wallner | 62/174 |
| 5,214,918 | A * | 6/1993 | Oguni et al. | 62/56 |
| 5,651,263 | A * | 7/1997 | Nonaka et al. | 62/205 |
| 5,737,931 | A * | 4/1998 | Ueno et al. | 62/126 |
| 6,070,420 | A * | 6/2000 | Biancardi et al. | 62/114 |
| 6,209,338 | B1 * | 4/2001 | Thatcher, Jr. | 62/292 |
| 6,826,924 | B2 * | 12/2004 | Shimoda et al. | 62/324.4 |
| 6,857,285 | B2 * | 2/2005 | Hebert | 62/305 |
| 2002/0026803 | A1 * | 3/2002 | Inoue et al. | 62/228.3 |

FOREIGN PATENT DOCUMENTS

| | | | |
|---|---|---|---|
| EP | 1 207 360 | | 5/2002 |
| EP | 1 207 361 | | 5/2002 |
| JP | 07-035429 | A | 2/1995 |
| JP | 7-18602 | B2 | 3/1995 |
| JP | 09-217974 | A | 8/1997 |
| JP | 09-273839 | A | 10/1997 |
| JP | 10-115470 | A | 5/1998 |
| JP | 10-253203 | A | 9/1998 |
| JP | 11-014170 | | 1/1999 |
| JP | 11-142011 | | 5/1999 |
| JP | 2000-035250 | A | 2/2000 |
| JP | 2000-146322 | A | 5/2000 |
| JP | 2000-266415 | | 9/2000 |
| JP | 2001-004235 | A | 1/2001 |
| JP | 2001-141316 | A | 5/2001 |
| JP | 2001-304714 | | 10/2001 |
| JP | 2002-106959 | A | 4/2002 |
| JP | 2002-130770 | A | 5/2002 |
| JP | 2002-228282 | | 8/2002 |
| JP | 2002-310519 | A | 10/2002 |
| JP | 2003-247742 | A | 9/2003 |
| JP | 2003247742 | A * | 9/2003 |
| JP | 2003-279174 | A | 10/2003 |
| JP | 2004-100979 | A | 4/2004 |
| KR | 1998-023922 | | 7/1998 |
| WO | WO 90/07683 | A1 | 7/1990 |
| WO | WO 00/55551 | | 9/2000 |

OTHER PUBLICATIONS

International Search Report.

Supplementary European Search Report in corresponding Application No. 05790633.1-1266 dated Mar. 30, 2009.

Japanese Office Action issued on Mar. 29, 2010 in corresponding Japanese Patent Application No. 2004-343860, and an English translation thereof.

* cited by examiner

REFRIGERATING AIR CONDITIONING SYSTEM, METHOD OF CONTROLLING OPERATION OF REFRIGERATING AIR CONDITIONING SYSTEM, AND METHOD OF CONTROLLING AMOUNT OF REFRIGERANT IN REFRIGERATING AIR CONDITIONING SYSTEM

TECHNICAL FIELD

The invention relates to a refrigerating air conditioning system and, more specifically, to a refrigerating air conditioning system using a refrigerant used in a supercritical area such as carbon dioxide ($CO_2$).

BACKGROUND ART

In the related art, there is a refrigerating air conditioning system in which $CO_2$ is used as a refrigerant, a receiver for storing the refrigerant is provided at an exit of an evaporator or at an entrance of a decompression device, and the amount of refrigerant in the receiver is controlled, so as to control an operating high-pressure of the system to provide a predetermined cooling capability (for example, see Patent Document 1).

Patent Document 1: Japanese Patent Publication No. 7-18602 (P. 1-5, FIG. 2, FIG. 3)

DISCLOSURE OF INVENTION

Problems to be Solved by the Invention

The refrigerating air conditioning system in the related art has a problem as shown below since a decompression device is controlled to change an operating state of an evaporator for controlling the amount of a refrigerant in a receiver. There is a problem such that it takes a long time to stabilize the operation after occurrence of a state change in the evaporator, because the state change in the evaporator first of all causes a change of the amount of refrigerant in the receiver, and this change subsequently causes a change of the amount of refrigerant on the high-pressure side. In particular, in the case of multiple type refrigerating air conditioning system provided with a plurality of indoor side heat exchangers which serve as evaporators, the length of the extension pipe between the outdoor machine and the indoor machine is long, and hence it requires long time until the operation is stabilized, and the operation control is liable to be unstable. In the case of a multiple-type refrigerating air conditioning system, in order to control the system according to loaded states of respective indoor machines resulting from their installed conditions, decompression devices are generally provided corresponding to the evaporators of the respective indoor machines and are operated so that capabilities which match the loads are demonstrated by the control of the decompression devices. Therefore, there is a problem such that it is necessary to determine which one of the plurality of decompression devices should be used for adjusting the amount of refrigerant when controlling the amount of refrigerant by causing the state change in the evaporators, and hence the control is complicated. There is another problem such that when the decompression device is provided in the indoor machine, judgment control for adjusting the amount of refrigerant is performed in the outdoor machine and the judgment is transmitted to the indoor machine to perform the control of the decompression device, and hence the control is further complicated.

In view of such problems, it is an object of the invention to provide a refrigerating air conditioning system which can control the distribution of the amount of a refrigerant in the refrigerating air conditioning system easily and quickly to achieve a stable operation control.

It is known that a high-pressure value at which the coefficient of operation (COP) becomes a maximum value exists according to the operating state in a refrigeration cycle employing a cooling media used in a supercritical area such as $CO_2$, and hence it is an object of the invention to provide a refrigerating air conditioning system in which the high-pressure value is set to be near the high-pressure value at which the maximum COP is obtained by controlling the distribution of the amount of refrigerant so that efficient operation is realized.

It is an object of the invention to provide a method of controlling the operation of the refrigerating air conditioning system described above.

It is also an object of the invention to provide a method of controlling the amount of refrigerant of the refrigerating air conditioning system described above.

Means for Solving the Problems

A refrigerating air conditioning system according to the invention includes: a refrigeration cycle configured to circulate refrigerant through a compressor, a user side heat exchanger, a user side decompression device, a heat source side decompression device and a heat source side heat exchanger and operated with a high-pressure value being a pressure higher than a critical pressure of the refrigerant and a low-pressure value being a pressure lower than the critical pressure; a refrigerant amount adjusting circuit which can increase and decrease the amount of refrigerant existing in the refrigeration cycle; superheat controlling means for controlling the heat source side decompression device so that the superheat at an exit of the heat source side heat exchanger becomes a predetermined value during a heat utilized operation in which heat is supplied by the user side heat exchanger; and refrigerant amount controlling means for adjusting and controlling the amount of refrigerant existing in the user side heat exchanger by the refrigerant amount adjusting circuit during the heat utilized operation so that the temperature or the pressure of the refrigerant circulating the refrigeration cycle becomes in a predetermined state.

A method of controlling the refrigerating air conditioning system according to the invention includes a refrigerating air conditioning step for configuring a refrigeration cycle by circulating refrigerant through a compressor, a radiator, a decompression device and an evaporator and operating a high-pressure side from the discharge side of the compressor to the inlet port of the decompression device at a pressure equal to or higher than the critical pressure and a low-pressure side from the exit of the decompression device to the inlet port of the compressor at a pressure lower than the critical pressure to perform refrigerating air conditioning by the evaporator or the radiator; a superheat controlling step for controlling the superheat at the exit of the evaporator to be the predetermined value; and a refrigerant amount controlling step for adjusting the amount of refrigerant existing in the radiator by storing the excessive refrigerant in the refrigerant storage means which can be connected and disconnected with respect to the refrigeration cycle.

The refrigerant amount controlling means in the refrigerating air conditioning system according to the invention includes a high-pressure high-temperature refrigerant storing step for causing high-temperature high-pressure refrigerant flowing in a refrigerant pipe from a discharge port of a compressor to an inlet port of a radiator flow into a refrigerant storage container so as to store the high-pressure high-temperature refrigerant in the refrigerant storage container when performing refrigerating air conditioning with the evaporator or the radiator by circulating the refrigerant through the compressor, the radiator, the decompression device and the evaporator; a high-pressure low-temperature refrigerant storing step for causing the high-pressure low-temperature refrigerant flowing in the refrigerant pipe from the exit of the radiator to the inlet port of the decompression device to flow into the refrigerant storage container so as to store the high-pressure low-temperature refrigerant in the refrigerant storage container; and a low-pressure low-temperature refrigerant storing step for causing the high-pressure refrigerant stored in the refrigerant storage container to flow out to a suction side of the compressor, wherein the amount of the circulating refrigerant is adjusted by storing the refrigerant of different densities in the refrigerant storage container.

Advantages of the Invention

According to the invention, the operation is achieved while keeping the amount of refrigerant existing in the heat exchanger which serves as the evaporator generally constant by controlling the superheat at the exit of the heat exchanger which serves as the evaporator. By performing the adjustment of the amount of refrigerant by the refrigerant amount adjusting circuit in this state, the amount of the refrigerant existing in the radiator can be adjusted stably and quickly for operation. By adjusting the amount of refrigerant to be circulated on the high-pressure side to control the high-pressure value to be the target high-pressure value, the refrigerating air conditioning system which can be operated in high efficiency can be obtained.

In addition, the method of controlling the refrigerating air conditioning system, which can quickly adjust the amount of refrigerant existing in the radiator and control the high-pressure value to achieve the operation in a state of high efficiency, can be obtained.

By storing the refrigerants in different densities in the refrigerant storage container, the method of controlling the amount of refrigerant of the refrigerating air conditioning system which can change the amount of refrigerant to be stored in the refrigerant storage container, and can increase and decrease the amount of refrigerant existing in the radiator in a wide range can be obtained.

BEST MODE FOR CARRYING OUT THE INVENTION

First Embodiment

Figure 1:
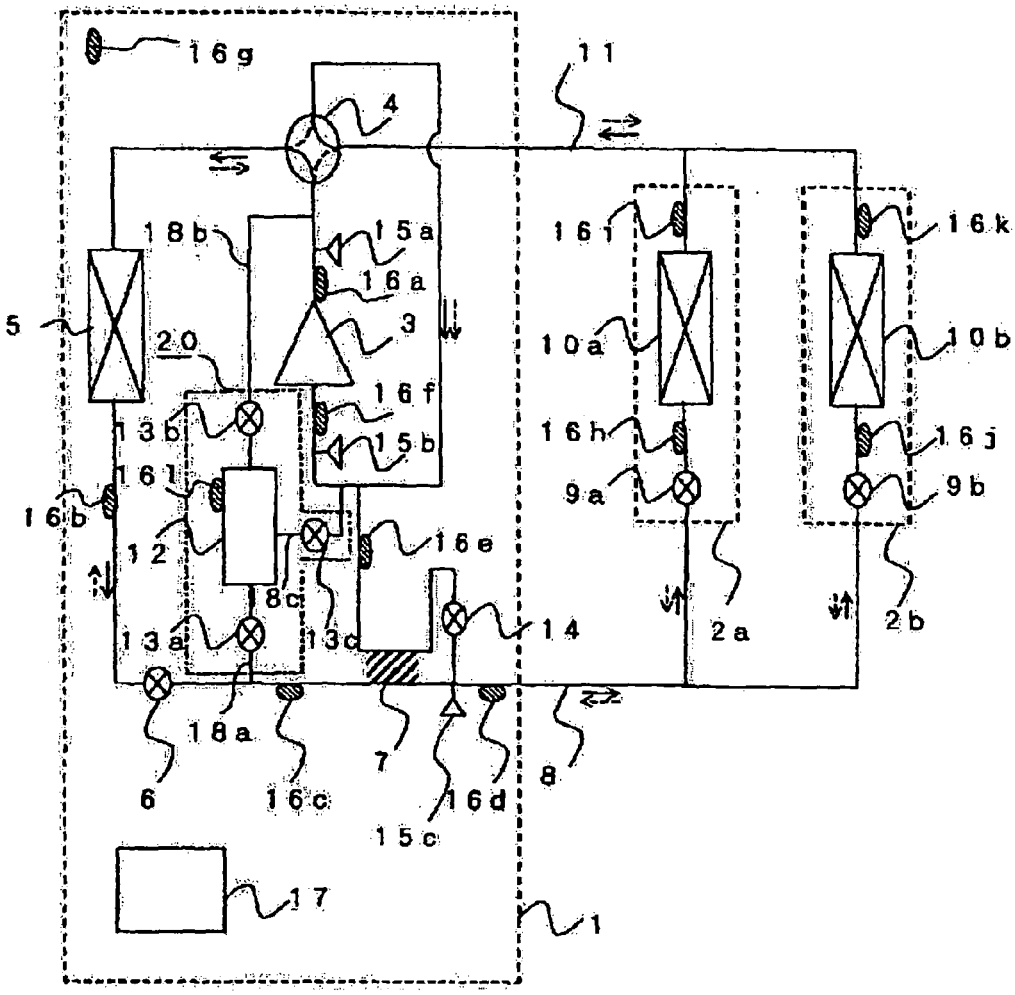
FIG. 1 is a refrigerant circuit diagram of a refrigerating air conditioning system according to a first embodiment of the invention.

Hereinafter, a first embodiment of the invention will be described. FIG. 1 is a refrigerant circuit diagram showing a refrigerating air conditioning system according to the first embodiment of the invention, in which an outdoor machine 1 accommodates a compressor 3, a four-way valve 4 as a flow path switching valve, an outdoor side heat exchanger 5 as a heat-source side heat exchanger, an outdoor side expansion valve 6 as an outdoor side decompression device, a high-low pressure heat exchanger 7, a refrigerant storage container 12, a flow rate control valve 13*a* provided on a connecting pipe 18*a* which connects the refrigerant storage container 12 and the portion which serves as an exit of the outdoor side heat exchanger 5 during cooling operation, a flow rate control valve 13*b* provided on a connecting pipe 18*b* for connecting the refrigerant storage container 12 and a discharge side of the compressor 3, a flow-rate control valve 13*c* provided on a connecting pipe 18*c* for connecting the refrigerant storage container 12 and the suction side of the compressor 3, and a flow-rate control valve 14 provided on a flow channel bypassed to the low-pressure side of the high-low pressure heat exchanger 7. The refrigerant storage container 12, the flow rate controlling valves 13*a*, 13*b*, 13*c*, the connecting pipes 18*a*, 18*b*, 18*c* constitute a refrigerant amount adjusting circuit 20.

The compressor 1 is of a type whose capacity is controlled by controlling the number of revolution with an inverter, and the outdoor side expansion valve 6 and indoor side expansion valves 9*a*, 9*b* are electronic expansion valves whose opening is variably controlled.

On the side of the user, there are a plurality of, for example, two indoor machines 2*a*, 2*b* provided, and the indoor machines 2*a*, 2*b* accommodate indoor side expansion valves 9*a*, 9*b* as indoor side decompression device and indoor side heat exchangers 10*a*, 10*b* as user side heat exchangers mounted thereon. A liquid pipe 8 and a gas pipe 11 are connecting pipes for connecting the outdoor machine 1 and the indoor machines 2*a*, 2*b*. As the refrigerant of the refrigerating air conditioning system, for example, $CO_2$ is used.

In the outdoor machine 1, there are installed a pressure sensor 15*a* on the discharge side of the compressor 3, a pressure sensor 15*b* on the suction side of the compressor 3, and a pressure sensor 15*c* between the outdoor side expansion valve 6 and the liquid pipe 8, so as to measure the pressure of the refrigerant at each point of installation. There are also installed a temperature sensor 16*a* on the discharge side of the compressor 3, a temperature sensor 16*b* between the outdoor side heat exchanger 5 and the outdoor side expansion valve 6, a temperature sensor 16*c* between the outdoor expansion valve 6 and the high-low pressure heat exchanger 7, a temperature sensor 16*d* between the high-low pressure heat exchanger 7 and the liquid pipe 8, a temperature sensor 16*e* on the low pressure exit side of the high-low pressure heat exchanger 7, and a temperature sensor 16*f* at the suction side of the compressor 3, so as to measure the temperature of the refrigerant at each points of installation. A temperature sensor 16*g* measures the temperature of the external air around the outdoor machine 1, and a temperature sensor 16*l* is provided in the refrigerant storage container 12 for measuring the refrigerant store in the refrigerant storage container 12.

In the indoor machines 2*a*, 2*b*, there are installed temperature sensors 16*h*, 16*j* between the indoor side heat exchangers 10*a*, 10*b* and the indoor side expansion valves 9*a*, 9*b*, and temperature sensors 16*i*, 16*k* between the indoor side heat exchangers 10*a*, 10*b* and the gas pipe 11, so as to measure the temperature of the refrigerant at each points of installation.

In the outdoor machine 1, there is provided a measurement control device 17 composed of, for example, a microcomputer, so as to control the method of operation of the compressor 3, switching-over of the flow path of the four-way valve 4, the heat exchange amount of the outdoor side heat exchanger 5, the opening of the outdoor side expansion valve 6, and the opening of the flow-rate control valves 13, 14, on the basis of measurement information obtained by the pressure sensors 15 and the temperature sensors 16 and the operation instruction supplied from the user of the refrigerating air conditioning system.

In this document, the outdoor machine 1 in which the compressor 3 is housed is referred to as heat source side and the indoor machine 2 is referred to as user side, in the case of viewing the entire refrigerating air conditioning system or installation without limitations of the indoor or the outdoor. Therefore, the outdoor side heat exchanger 5 is referred to as a heat source side heat exchanger, the outdoor side expansion valve 6 is referred to as a heat source side decompression device, the indoor side heat exchanger 10 is referred to as a user side heat exchanger, and the indoor side expansion valve 9 is referred to as a user side decompression device.

Subsequently, the operating action in the refrigerating air conditioning system will be described. First of all, the action during the cooling operation, which corresponds to a cold heat operation utilization mode, will be described. During the cooling operation, the flow channel of the four-way valve 4 is set to a direction indicated by a solid line in FIG. 1, and the refrigerant flows in the direction indicated by a solid arrow. A high-temperature high-pressure gas refrigerant discharged from the compressor 3 flows into the outdoor side heat exchanger 5 through the four-way valve 4 and radiates heat in the outdoor side heat exchanger 5 as the radiator to be cooled down. In this embodiment, since the operation is performed with the high-pressure value which is higher than the critical pressure of the refrigerant, the refrigerant radiates heat and is cooled down in the supercritical state. When the high-pressure value becomes lower than the critical pressure, the refrigerant radiates heat while being liquefied. The refrigerant at high-pressure and low temperature coming out from the outdoor side heat exchanger 5 is slightly decompressed by the outdoor side expansion valve 6, and then exchanges heat with the refrigerant which is obtained by branching and decompressing at the exit of the high-low pressure heat exchanger 7 and hence is further cooled down to a lower temperature. Subsequently, the refrigerant flows into the indoor machines 2*a*, 2*b* through the liquid pipe 8. Then, the refrigerant is decompressed by the indoor side expansion valves 9*a*, 9*b* into a low-pressure two-phase state, flows into the indoor side heat exchangers 10*a*, 10*b* which serve as evaporators, absorbs heat and hence is evaporated therein to supply cold heat to a load-side medium such as air or water on the indoor machine side. The low-pressure gas refrigerant coming out from the indoor side heat exchangers 10*a*, 10*b* comes out from the indoor machines 2*a*, 2*b*, flows into the outdoor machine 1 through the gas pipe 11, and then is sucked into the compressor 3 through the four-way valve 4. A part of the refrigerant obtained by branching at the exit of the high-low pressure heat exchanger 7 is decompressed by the flow-rate control valve 14, is converted into the low-pressure two-phase state, flows into the high-low pressure heat exchanger 7, is heated by the refrigerant on the high-pressure, is evaporated and converted into a low pressure gas refrigerant, is mixed with the refrigerant flowing therein from the indoor machines 2*a*, 2*b* through the gas pipe 11, and is sucked into the compressor 3.

Then, the action during the heating operation, which is a heat utilization operation mode, will be described. At the time of the heating operation, the flow path of the four-way valve 4 is set to the direction indicated by a broken line in FIG. 1, and the refrigerant flows in the direction indicated by a broken arrow. Then, the gas refrigerant at a high-temperature high-pressure discharged from the compressor 3 flows out from the outdoor machine 1 through the four-way valve 4, and flows into the indoor machines 2*a*, 2*b* through the gas pipe 11. Then, it flows into the indoor side heat exchangers 10*a*, 10*b*, and reduces in temperature while radiating heat in the indoor side heat exchangers 10*a*, 10*b*, which serve as the radiators. In this embodiment, since the operation is performed with the high-pressure value which is higher than the critical pressure of the refrigerant, the refrigerant radiates heat and is cooled down in the supercritical state. When the high-pressure value is lower than the critical pressure, the refrigerant radiates heat while being liquefied. Heat radiated from the refrigerant is provided to the load-side medium such as air or water to perform heating. The refrigerant at high-pressure low-temperature which came out from the indoor side heat exchangers 10*a*, 10*b* is slightly decompressed by the indoor side expansion valves 9*a*, 9*b*, flows into the outdoor machine 1 through the liquid pipe 8, and then exchanges heat with the refrigerant obtained by branching at an inlet port of the high-low pressure heat exchanger 7 to be further cooled down to a lower temperature. Then, the refrigerant is decompressed by the outdoor side expansion valve 6 into the low-pressure two-phase state, flows into the outdoor side heat exchanger 5 which serves as evaporator, absorbs heat and hence is evaporated therein. The low-pressure gas refrigerant coming out from the outdoor side heat exchanger 5 is sucked into the compressor 3 through the four-way valve 4. A part of the refrigerant obtained by branching at the inlet port of the high-low pressure heat exchanger 7 is decompressed by the flow-rate control valve 14, is converted into the low-pressure two-phase state, flows into the high-low pressure heat exchanger 7, is heated by the refrigerant on the high-pressure side, is evaporated and converted into a low pressure gas refrigerant, is mixed with the refrigerant sucked into the compressor 3 through the four-way valve 4, and is sucked into the compressor 3.

Figure 2:
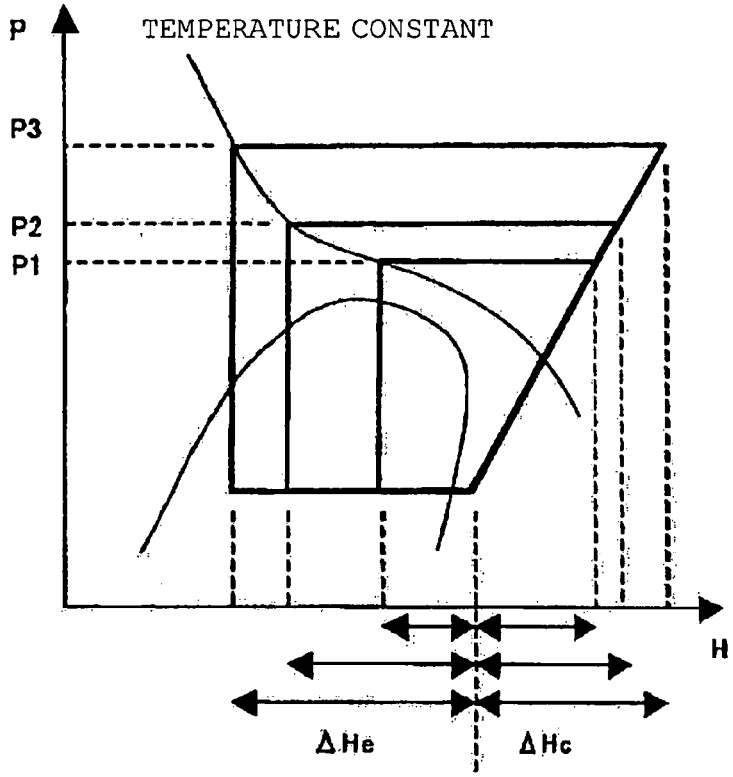
FIG. 2 is a PH diagram indicating an operating state of the refrigerating air conditioning system when the high-pressure is varied according to the first embodiment of the invention.
Figure 3:
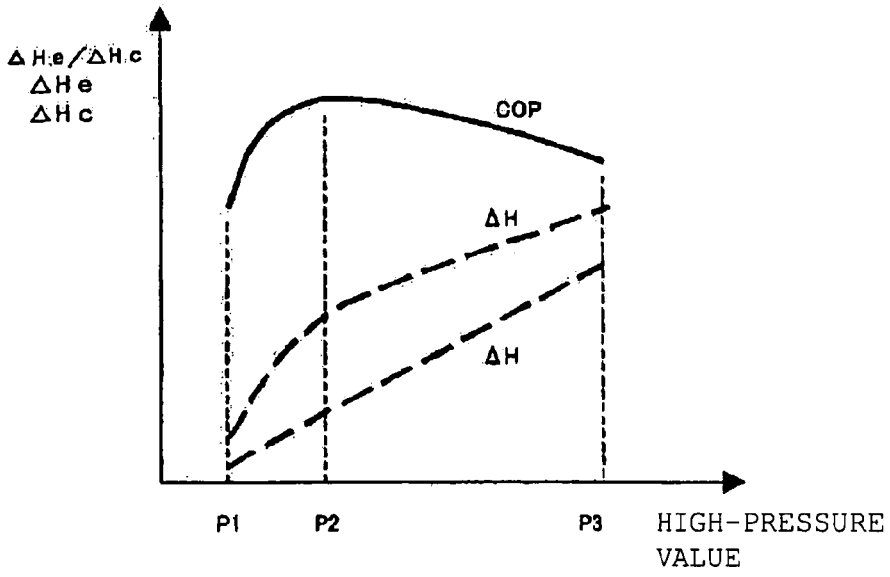
FIG. 3 is a graph showing a correlation between the high pressure and the coefficient of operation COP according to the first embodiment of the invention.

Subsequently, the operation control action in the refrigerating air conditioning system will be described. In the refrigeration cycle in which the high-pressure side is operated in the supercritical state as in the case in which the refrigerant is $CO_2$, as is well known, a high-pressure value, at which the coefficient of operation becomes a maximum value, exists. FIG. 2 is a PH diagram of the refrigeration cycle in the case where the high-pressure value is varied and the radiator exit temperature is constant. In FIG. 2, when the high-pressure value increases to P1, P2 and P3, the enthalpy difference ΔHe in the evaporator increases, and the refrigeration capability increases correspondingly. On the other hand, when the high-pressure value increases, the enthalpy difference ΔHc in the compressor which corresponds to the input of the compressor also increases. The tendency of variations of ΔHe and ΔHc caused by the variation of the high-pressure value is as shown in FIG. 3. FIG. 3 is a graph showing the high-pressure value in the lateral axis and the enthalpy and the COP in the vertical axis. The values of ΔHe and ΔHc are shown by the broken line and the COP is shown by the solid line corresponding to P1, P2 and P3 in FIG. 2. As shown in FIG. 3, in an area in which the increasing rate of ΔHe corresponding to the capability in association with increase in high-pressure exceeds the increasing rate of ΔHc corresponding to an input, the efficiency COP of the refrigeration cycle which is expressed by ΔHe/ΔHc increases. In contrast, in the area in which the increasing rate of the ΔHe corresponding to the capability is lower than increasing rate of ΔHc corresponding to the input, the value of COP is lowered. Therefore, the high-pressure value, at which the COP becomes a maximum value exists, or in the case of FIG. 3, P2 corresponds thereto. The high-pressure value at which the COP becomes the maximum value is a value which varies with the amount of heat exchange of the radiator and the radiator exit temperature.

The high pressure value in the refrigerating air conditioning system is determined by the amount of refrigerant existing in the radiator. When the refrigerant is the supercritical state, the density of the refrigerant increases with the pressure. Therefore, the amount of refrigerant in the radiator during operation at the high pressure value P3 in FIG. 2 is larger than the amount of refrigerant in the radiator during operation at the high-pressure value P1. In contrast, when it is operated so that the amount of refrigerant existing in the radiator increases, the high-pressure value increases, and when it is operated so that the amount of refrigerant existing in the radiator is decreased, the high-pressure value is lowered. Therefore, in this embodiment, the high pressure value is controlled to be a value near the pressure, at which the maximum COP is achieved, by controlling the amount of refrigerant existing in the radiator.

Figure 4:
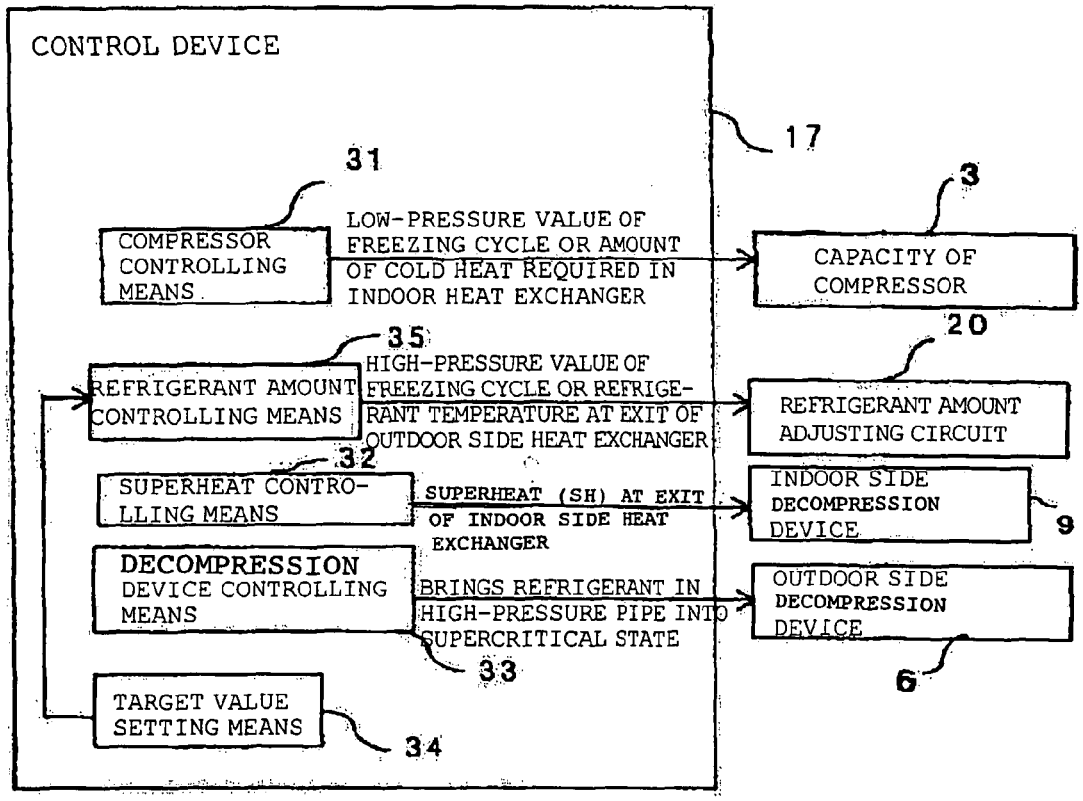
FIG. 4 is an explanatory diagram showing a configuration of a control device in a cooling operation according to the first embodiment of the invention.
Figure 5:
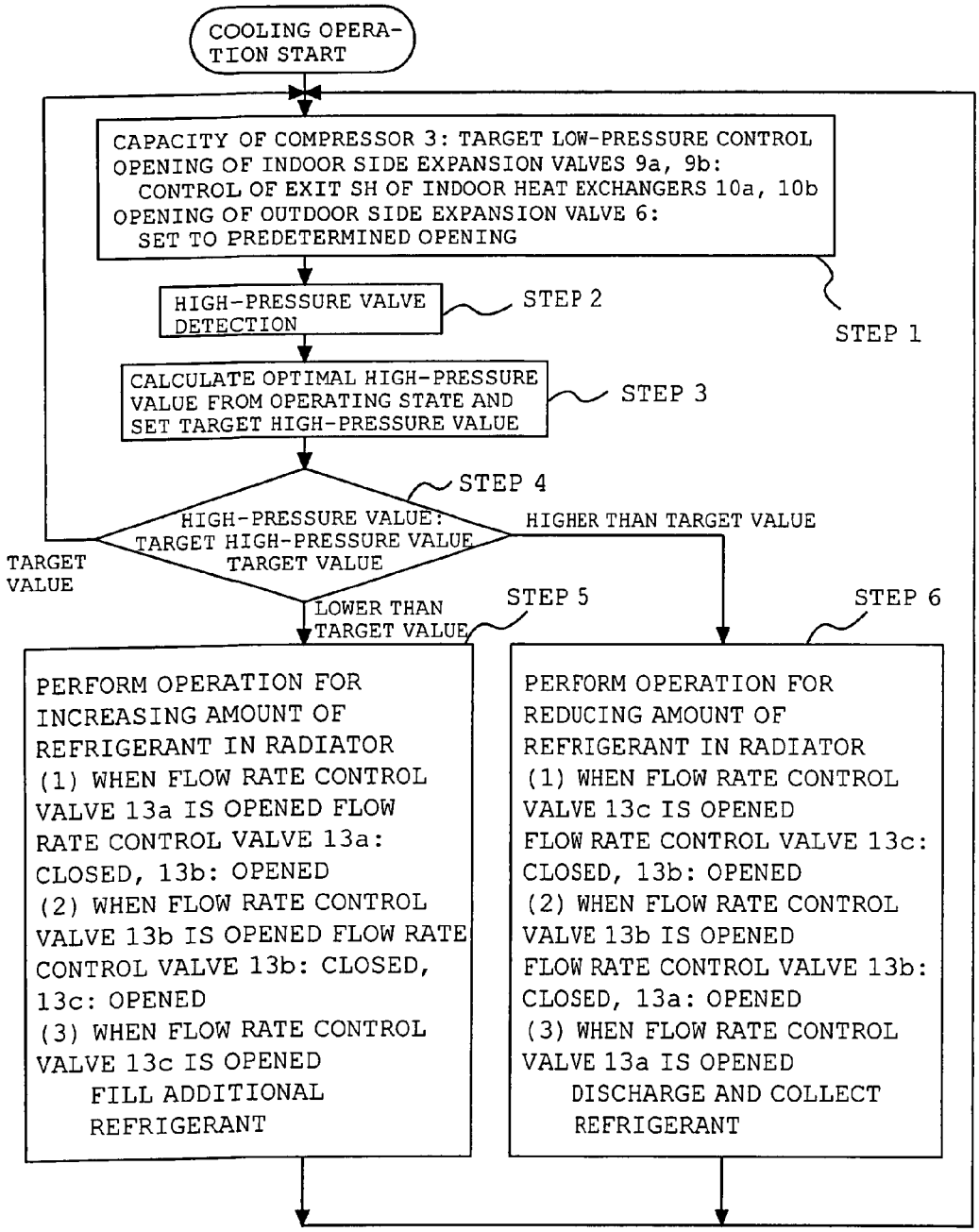
FIG. 5 is a flowchart showing a controlling action in the cooling operation according to the first embodiment of the invention.

Referring now to FIG. 4 and FIG. 5, the control action performed by the measurement control device 17 during the cooling operation will be described. FIG. 4 shows a configuration of the control device 17 in the cooling operation, and FIG. 5 is a flowchart showing the control action of the control device 17 during the cooling operation. In the cooling operation, the indoor side heat exchangers 10*a*, 10*b* serve as the evaporators, the evaporating temperature (the two-phase refrigerant temperature of the evaporator) is set so that a predetermined amount of heat exchange is demonstrated, and the low pressure value which realizes the evaporating temperature is set as a target low pressure value. Then, the rotating number is controlled with the inverter by compressor controlling means 31. The operating capacity of the compressor 3 is controlled so that the low pressure value measured by the pressure sensor 15*b* becomes a preset target value, for example, a low pressure corresponding to a saturation temperature of 10° C. Superheat controlling means 32 controls the opening of the indoor side expansion valve 9*a* so that the superheat of the refrigerant at the exit of the indoor side heat exchanger 10*a* computed by subtracting the temperature sensed by the temperature sensor 16*h* from the temperature sensed by the temperature sensor 16*i* becomes the target value. In the same manner, the superheat controlling means 32 controls the opening of the indoor side expansion valve 9*b* so that the superheat of the refrigerant at the exit of the indoor side heat exchanger 10*b* computed by subtracting the temperature sensed by the temperature sensor 16*j* from the temperature sensed by the temperature sensor 16*k* becomes the target value. As the target value, the predetermined target value, for example, 5° C. is used. The outdoor side expansion valve 6 is controlled to an initial opening which is predetermined by decompression device controlling means 33, for example, a predetermined opening which is a fully opened state or close to the fully opened state. The operation is performed with the number of revolution of a fan and the flow rate of a pump for transporting a heat transfer medium such as air or water in a state predetermined from the amount of heat exchange of the outdoor side heat exchanger 5 and the amount of heat exchange of the indoor side heat exchanger 10*a*, 10*b*. The opening of the flow rate control valve 14 is controlled so that the superheat of the refrigerant at the low-pressure side exit of the high-low pressure heat exchanger 7, which is computed by subtracting the refrigerant saturating temperature converted from the low-pressure measured by the pressure sensor 15*b* from the temperature sensed by the temperature sensor 16*e*, becomes a target value. As the target value, a predetermined target value, for example, 5° C. is used. Since the opening of the outdoor side expansion valve 6 is the predetermined opening which is fully opened or close to fully-opened state, the refrigerant coming out from the outdoor side heat exchanger 5 is controlled so as to be decompressed little in the outdoor side expansion valve 6. At this time, since a portion on upstream side of the indoor side expansion valves 9*a*, 9*b* is preferably operated in the supercritical state, the opening of the outdoor side expansion valve 6 is controlled so that the pressure measured by the pressure sensor 15*c* reaches the critical pressure or higher. The opening of the outdoor side expansion valve 6 is increased when the pressure measured by the pressure sensor 15*c* is below the critical pressure. The control process described above is shown in Step 1 in FIG. 5.

The high-pressure value during operation in this state is sensed by the pressure sensor 15*a* (Step 2). Then, an optimal high-pressure value, at which the COP becomes the maximum value, is computed by a predetermined arithmetic expression according to the operating states such as the temperature at the exit of the outdoor side heat exchanger 5 serving as the radiator, measured by the temperature sensor 16*b*, the outside air temperature sensed by the temperature sensor 16*g*, and the operating capacity of the compressor 3. Then, the target high-pressure value of the refrigeration cycle is set by the target value setting means 34 on the basis of the optimal high-pressure value (Step 3). Here, the target high-pressure value set by the target value setting means 34 is set in the pressure range close to the optimal high-pressure value at which the maximum COP is achieved. Then, the target high-pressure value and the measured high-pressure are compared (Step 4). As a result of comparison, when it does not fall within the range of the target high-pressure value, the refrigerant amount adjusting circuit 20 is controlled by refrigerant amount controlling means 35 to adjust the amount of refrigerant existing in the outdoor side heat exchanger 5 as show in Step 5 and Step 6. More specifically, when the current high-pressure value is lower than the target high-pressure value, a radiator-refrigerant-amount-increasing operation for increasing the amount of refrigerant in the outdoor side heat exchanger 5 serving as the radiator is performed in Step 5. In contrast, when the current high-pressure value is higher than the target high-pressure value, a radiator-refrigerant-amount-decreasing operation for decreasing the amount of refrigerant in the outdoor side heat exchanger 5 is performed in step 6. When the high pressure value satisfies the target high-pressure value in the comparison in Step 4, the procedure returns to Step 1.

A method of controlling the amount of refrigerant in the outdoor side heat exchanger 5 shown in Step 5 and Step 6 in the refrigerant amount controlling means 35 will be described further in detail. The amount of refrigerant existing in the outdoor side heat exchanger 5 is adjusted by changing the density of the refrigerant stored in the refrigerant storage container 12. In this embodiment, opening-closing valves which can simply open and close are used as the flow rate control valves 13*a*, 13*b*, 13*c* to control the opening and closing, so as to store any one of the refrigerant flowing in the refrigerant pipe connected to the flow rate control valve 13*a* (high-pressure low-temperature), the refrigerant flowing in the refrigerant pipe connected to the flow rate control valve 13*b* (high-pressure, high-temperature), and the refrigerant flowing in the refrigerant pipe connected to the flow-rate control valve 13*c* (low-pressure, low-temperature) in the refrigerant storage container 12.

When the flow rate control valve 13*a* is opened and the flow rate control valves 13*b*, 13*c* are closed, the high-pressure low-temperature refrigerant coming out from the outdoor side heat exchanger 5 flows into the refrigerant storage container 12 through the connecting pipe 18*a*, and hence the refrigerant in the supercritical state at high-pressure high-temperature stays in the refrigerant storage container 12. When the flow rate control valve 13*b* is opened and the flow rate control valves 13*a*, 13*c* are closed, the high-pressure high-temperature refrigerant discharged from the compressor 3 flows into the refrigerant storage container 12 through the connecting pipe 18*b*, and hence the high-pressure high-temperature refrigerant in the supercritical state stays therein. When the flow rate control valve 13*c* is opened and the flow rate control valves 13*a*, 13*b* are closed, if the high pressure refrigerant is stored in the refrigerant storage container 12, the refrigerant flows out to the suction side of the compressor 3 through the connecting pipe 18*c*, and the state of the refrigerant in the refrigerant storage container 12 becomes the same state as the refrigerant sucked into the compressor 3, so that the low-pressure low-temperature gas refrigerant stays therein.

As the density of the refrigerant is;

high-pressure low-temperature refrigerant in the supercritical state>high-pressure high-temperature refrigerant in the supercritical state>gas refrigerant at low-pressure low-temperature, the amount of refrigerant in the refrigerant storage container 12 is;

the case where the flow rate control valve 13*a* is opened>the case where the flow rate control valve 13*b* is opened>the case where the flow rate control valve 13*c* is opened.

Portions in the refrigerating air conditioning system except the outdoor side heat exchanger 5 and the refrigerant storage container 12, where the capacity is large and hence a large amount of refrigerant may stay, are the liquid pipe 8, the indoor side heat exchangers 10*a*, 10*b* and the gas pipe 11. However, in the case of the liquid pipe 8, as the opening of the outdoor side expansion valve 6 is controlled to be substantially fully opened, so that the high-pressure low-temperature refrigerant in the supercritical state always stays, significant variations in the amount of Refrigerant do not occur. As regards the indoor side heat exchangers 10*a*, 10*b*, as the superheat and the low pressure at the exit of the heat exchangers are controlled so as to be the same by the control of the indoor side expansion valves 9*a*, 9*b* and the control of the compressor 3, significant variations in the amount of refrigerant do not occur as well. The gas pipe 11 is also controlled to a low-pressure low-temperature gas state by the same control, and hence significant variations in the amount of refrigerant do not occur as well. Since the amount of refrigerant filled in the refrigerating air conditioning system is constant, when variations in the amount of refrigerant occurs in the refrigerant storage container 12, the influence thereof is reflected on the amount of refrigerant in the outdoor side heat exchanger 5. In other words, when the amount of refrigerant in the refrigerant storage container 12 increases, the amount of refrigerant in the outdoor side heat exchanger 5 decreases, and when the amount of refrigerant in the refrigerant storage container 12 decreases, the amount of refrigerant in the outdoor side heat exchanger 5 increases.

Therefore, when the current high-pressure value is lower than the target high-pressure value which achieves a high COP, the control may be performed to increase the amount of refrigerant existing in the outdoor side heat exchanger 5 serving as the radiator. Therefore, when the flow rate control valve 13*a* is opened, the flow rate control valve 13*a* is controlled to be closed and the flow rate control valve 13*b* is controlled to be opened, and when the flow rate control valve 13*b* is opened, the flow rate control valve 13*b* is controlled to be closed and the flow rate control valve 13*c* is controlled to be opened. When the flow rate control valve 13*c* is opened, the filled amount of the refrigerant is smaller than the require amount, and hence countermeasures such as additionally filling the refrigerant or reducing the capacity of the refrigerant storage container 12 are necessary.

The actual action of the flow rate control valves 13 is such that when the flow rate control valve 13*a* is opened, the flow rate control valve 13*a* is closed and the flow rate control valve 13*c* is opened so that the high-pressure low-temperature refrigerant stored in the refrigerant storage container 12 flows out to the low pressure side through the connecting pipe 18*c* and the flow rate control valve 13*c*. Subsequently, the flow rate control valve 13*c* is closed and the flow rate control valve 13*b* is opened so that the high-pressure high-temperature refrigerant flows into the refrigerant storage container 12 through the flow rate control valve 13*b* and the connecting pipe 18*b* and is stored therein. When the flow rate control valve 13*b* is opened, the flow rate control valve 13*b* is closed and the flow rate control valve 13*c* is opened, so that the high-pressure high-temperature refrigerant stored in the refrigerant storage container 12 flows out to the low-pressure side through the flow rate control valve 13*c* and the connecting pipe 18*c*, and the refrigerant stored in the refrigerant storage container 12 becomes low-pressure and low-temperature. The timing of opening and closing the flow rate control valves 13*b*, 13*c* when replacing the high-pressure high-temperature refrigerant with the high-pressure low-temperature refrigerant may be controlled by detecting the temperature of the refrigerant storage container 12 by the temperature sensor 16*l* or may be set in advance to open and close at a predetermined time.

In contrast, when the current high-pressure value is higher than the target high-pressure value at which the significant COP can be obtained, the amount of refrigerant existing in the outdoor side heat exchanger 5 which serves as the radiator may be controlled to be smaller. Therefore, when the flow rate control valve 13*c* is opened, the flow rate control valve 13*c* is closed and the flow rate control valve 13*b* is opened so that the high-pressure and high-temperature refrigerant flows into the refrigerant storage container 12 through the flow rate control valve 13*b* and is stored therein. When the flow rate control valve 13*b* is opened, the flow rate control valve 13*b* is closed, and the flow rate control valve 13*a* is opened, so that the high-pressure low-temperature refrigerant flows through the flow rate control valve 13*a* into the refrigerant storage container 12 and is stored therein. When the flow rate control valve 13*a* is opened, the amount of refrigerant to be filled is larger than the required amount, countermeasures such as discharging and collecting the refrigerant from the device or increasing the capacity of the refrigerant storage container 12 are necessary.

The actual action of the flow rate control valve 13 is such that when the flow rate control valve 13*c* is opened, the flow rate control valve 13*b* is opened so that the high-pressure high-temperature refrigerant is stored in the refrigerant storage container 12 through the flow rate control valve 13*b* and the connecting pipe 18*b*. When the flow rate control valve 13*b* is opened, the flow rate control valve 13*b* is closed and the flow rate control valve 13*c* is opened so that the high-pressure high-temperature refrigerant flows out to the low-pressure side through the flow rate control valve 13*c* and the connecting pipe 18*c*. Subsequently, the flow rate control valve 13*c* is closed and the flow rate control valve 13*a* is opened so that the high-pressure low-temperature refrigerant flows into the refrigerant storage container 12 through the flow rate control valve 13*a* and the connecting pipe 18*a* and is stored therein. In this case as well, the timing of opening and closing the flow rate control valves 13*a*, 13*c* when replacing the high-pressure low-temperature refrigerant with the high-pressure high-temperature refrigerant may be controlled by detecting the temperature of the refrigerant storage container 12 by the temperature sensor 16*l* or may be set in advance so as to open and close at a predetermined time.

In this manner, in the cooling operation, by controlling the superheat at the exit of the heat exchanger as the evaporator to be a predetermined value, the operation can be performed in a state in which the amount of refrigerant existing in the heat exchanger as the evaporator is substantially constant. By adjusting the amount of refrigerant by the refrigerant amount adjusting circuit 20 in this state, the amount of refrigerant existing on the high-pressure side can be adjusted stably and quickly to control the operation. By setting the target high-pressure value and controlling the high-pressure value to realize a state to achieve the maximum coefficient of operation, by the amount of refrigerant circulating on the high-pressure side, the operation with high efficiency can be achieved and the operation of the refrigerating air conditioning system with high reliability and high efficiency can be achieved.

In particular, by controlling the opening and closing of the flow rate control valves 13*a*, 13*b*, 13*c* to increase and decrease the amount of refrigerant in the radiator, the high-pressure value can be controlled to be a value close to the high-pressure value at which the COP becomes maximum, so that the operation of the refrigerating air conditioning system with high efficiency can be realized.

In the above-described operation, the movement of the amount of refrigerant can be achieved so that the effect can be seen directly between the outdoor side heat exchanger 5 and the refrigerant storage container 12, but the amount of refrigerant is not controlled by causing the state change in the evaporator as in the conventional device, the control of the amount of refrigerant can be achieved stably in a short time, and hence the operation of the refrigerating air conditioning system with higher efficiency can be achieved stably.

In the refrigerant circuit shown in FIG. 1, the high-low pressure heat exchanger 7 is provided as a temperature adjusting heat exchange unit for adjusting the temperature of the refrigerant flowing in the pipe connecting the indoor side expansion valve 9 and the outdoor side expansion valve 6, so as to control the temperature of the refrigerant flowing in the liquid pipe 8 to be a predetermined temperature. Therefore, the amount of refrigerant existing in the liquid pipe 8 is controlled further accurately to achieve a stable operation.

Since it is configured that the decompression device controlling means 33 controls the outdoor side expansion valve 6 so that the state of the refrigerant in the pipe connecting the outdoor side expansion valve 6 and the indoor side expansion valves 9*a*, 9*b* becomes the supercritical state, the refrigerating air conditioning system which can be operated in a stable state of refrigerant can be obtained.

The compressor 3 is configured to be a variable capacity compressor, so that the capacity is controlled by the compressor controlling means 31 to make the low-pressure value of the refrigeration cycle to be a predetermined value. On the basis of the amount of cold heat required in the indoor side heat exchangers 10*a*, 10*b*, the low pressure value is set to obtain the amount cold heat, so that refrigerating air conditioning system which can reliably demonstrate the required capability can be obtained.

Here, the method of controlling the capacity of the compressor 3 may be as follows. Although the target low-pressure value is determined so that a predetermine amount of heat exchange is demonstrated by the indoor side heat exchangers 10*a*, 10*b* and the capacity is controlled, it is also possible to modify the method of controlling the capacity according to the cooling state on the load side. For example, when the load side is an indoor space, and the air temperature in the indoor space is higher than the preset air temperature set by the user of the device, an amount of heat exchange larger than that at the current moment is required. Therefore, the target low-pressure value is changed to a lower value. In contrast, when the air temperature in the indoor space is lower than the preset air temperature, the amount of heat exchange is excessive, and hence the target low-pressure value is changed to a higher value so that the amount of heat exchange becomes smaller than that of the current moment.

It is also possible to control the capacity of the compressor 3 directly on the basis of the cooling state on the load side such as the deviation between the preset air temperature and the air temperature in the indoor space without the intermediary of the low-pressure. For example, the capacity of the compressor 3 is increased when the air temperature in the indoor space is higher than the preset air temperature, and the capacity of the compressor 3 is reduced when the air temperature in the indoor space is lower than the preset air temperature.

In this manner, the refrigerating air conditioning system which can reliably demonstrate a required capability can be obtained also by employing the variable capacity compressor as the compressor 3 and controlling the capacity of the compressor 3 so that the amount of cold heat required in the indoor side heat exchangers 10*a*, 10*b* can be obtained by the compressor controlling means 31.

In the above-described system, the amount of refrigerant is adjusted and controlled by setting the target high-pressure value when the amount of refrigerant in the refrigerant storage container 12 is adjusted by the refrigerant amount controlling means 35. However, it is also possible to use the temperature of the refrigerant at the radiator exit. In other words, the target value of the refrigerant temperature at the exit of the outdoor side heat exchanger 5 is set and the amount of refrigerant is adjusted and controlled so that the refrigerant temperature at the exit of the outdoor side heat exchanger 5 becomes this target value. For example, the correlation between the high-pressure value, at which the maximum efficiency is achieved and the refrigerant temperature at the radiator exit is obtained in advance, the high pressure value detected by the pressure sensor 15*a* is used to determine the refrigerant temperature at the radiator exit at which the maximum efficiency is achieved, according to the obtained correlation using the high-pressure value sensed by the pressure sensor 15*a*, and the target value of the refrigerant temperature at the exit of the outdoor heat exchanger 5 is determined on the basis of the determined temperature. Then, the refrigerant temperature at the exit of the outdoor heat exchanger 5 sensed by the temperature sensor 16*b* and the target value is compared. When the actual refrigerant temperature is lower than the target value of the refrigerant temperature at the exit of the outdoor heat exchanger 5, the amount of refrigerant existing in the outdoor side heat exchanger 5 is too much. Therefore, the control action as shown in Step 6 in FIG. 5 is performed to reduce the amount of refrigerant existing in the outdoor side heat exchanger 5 so that the amount of refrigerant in the refrigerant storage container 12 is increased. In contrast, when the actual refrigerant temperature is higher than the target value of the refrigerant temperature at the exit of the outdoor heat exchanger 5, the amount of refrigerant existing in the outdoor side heat exchanger 5 is small. Therefore, the control action as shown in Step 5 in FIG. 5 is performed to increase the amount of refrigerant existing in the outdoor side heat exchanger 5 so that the amount of refrigerant in the refrigerant storage container 12 can be reduced. In this manner the refrigerating air conditioning system with high efficiency and high reliability can be obtained also by setting the target value of the refrigerant temperature at the radiator exit and controlling the amount of refrigerant existing on the high-pressure side.

Subsequently, the control action performed by the measurement control device 17 during the heating operation will be described. In the heating operation, since the indoor side heat exchangers 10*a*, 10*b* serve as the radiators, the high-pressure value which affects much the efficiency of the refrigeration cycle also affects the amount of heat exchange of the indoor side heat exchanger 10. Therefore, the operation is adapted not only to control the high pressure value while simply regarding the efficiency, but to realize the operation which achieves the amount of heat exchange of the indoor side heat exchanger 10 equivalent or larger than the requested amount and then achieve the effective operation.

Figure 6:
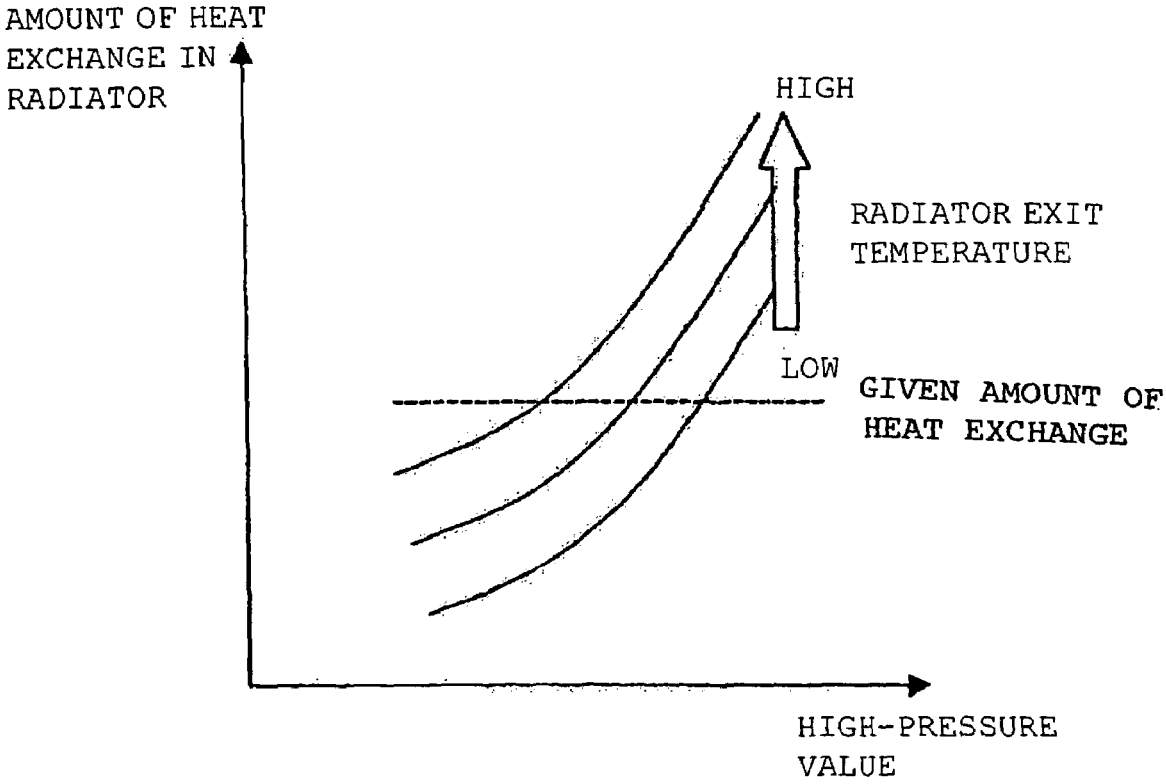
FIG. 6 is a graph showing a correlation between the high pressure and the heat exchange amount of a radiator according to the first embodiment of the invention.

The amount of heat exchange of the radiator is generally controlled by the high-pressure value of the refrigeration cycle and the radiator exit temperature. FIG. 6 is a graph showing the relation between the high pressure value and the amount of heat exchange of the radiator in the case of different temperatures at the radiator exit, in which the high pressure value is shown in the lateral axis and the amount of heat exchange of the radiator is shown in the vertical axis.

Figure 7:
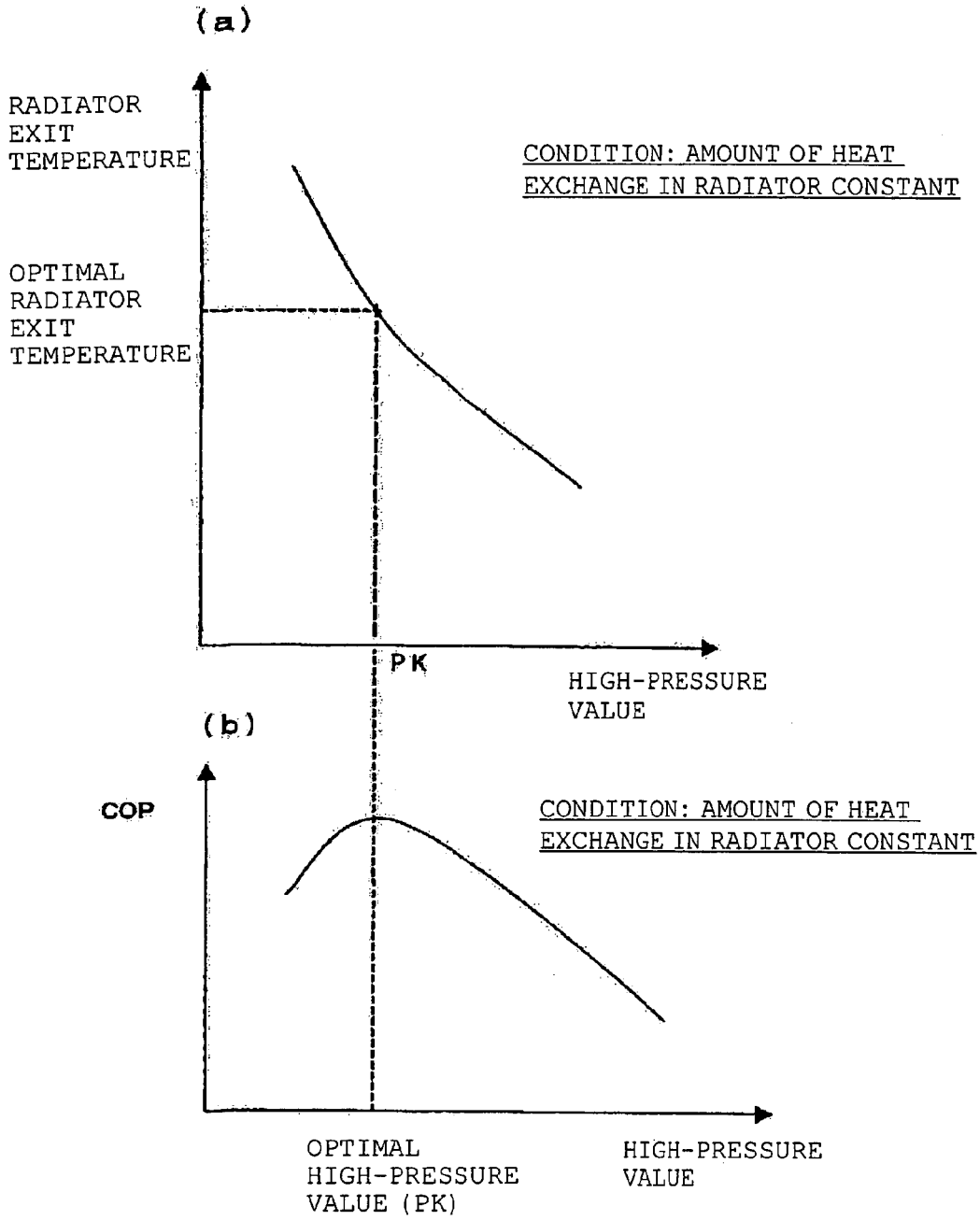
FIG. 7 illustrates a graph showing a correlation between the high pressure and the radiator exit temperature under the condition in which the heat exchange amount of the radiator is constant (FIG. 7(*a*)), and a graph showing a correlation between the high-pressure and the coefficient of operation under the condition in which the heat exchange mount of the radiator is constant according to the first embodiment of the invention.

As indicated by three curved lines in FIG. 6, they extend substantially in parallel with each other according to the height of the radiator exit temperature. The higher the high-pressure value is, or the higher the radiator exit temperature, the higher the average temperature of the refrigerant in the radiator becomes to increase the amount of heat exchange. When viewing a given amount of heat exchange, the lower the radiator exit temperature is, the higher the high-pressure value becomes. The radiator exit temperature with respect to the high-pressure value under the condition of a given amount of heat exchange of the radiator is shown in FIG. 7(*a*) and the value of COP with respect to the high-pressure value is shown in FIG. 7(*b*). As shown in FIG. 7(*a*), the relation between the high-pressure value and the radiator exit temperature under the condition of the given amount of heat exchange is obtained. In determination of the efficiency of the refrigeration cycle in this relation, there exists a high-pressure value (PK) at which the efficiency COP becomes a maximum value as shown in FIG. 7(*b*).

Figure 8:
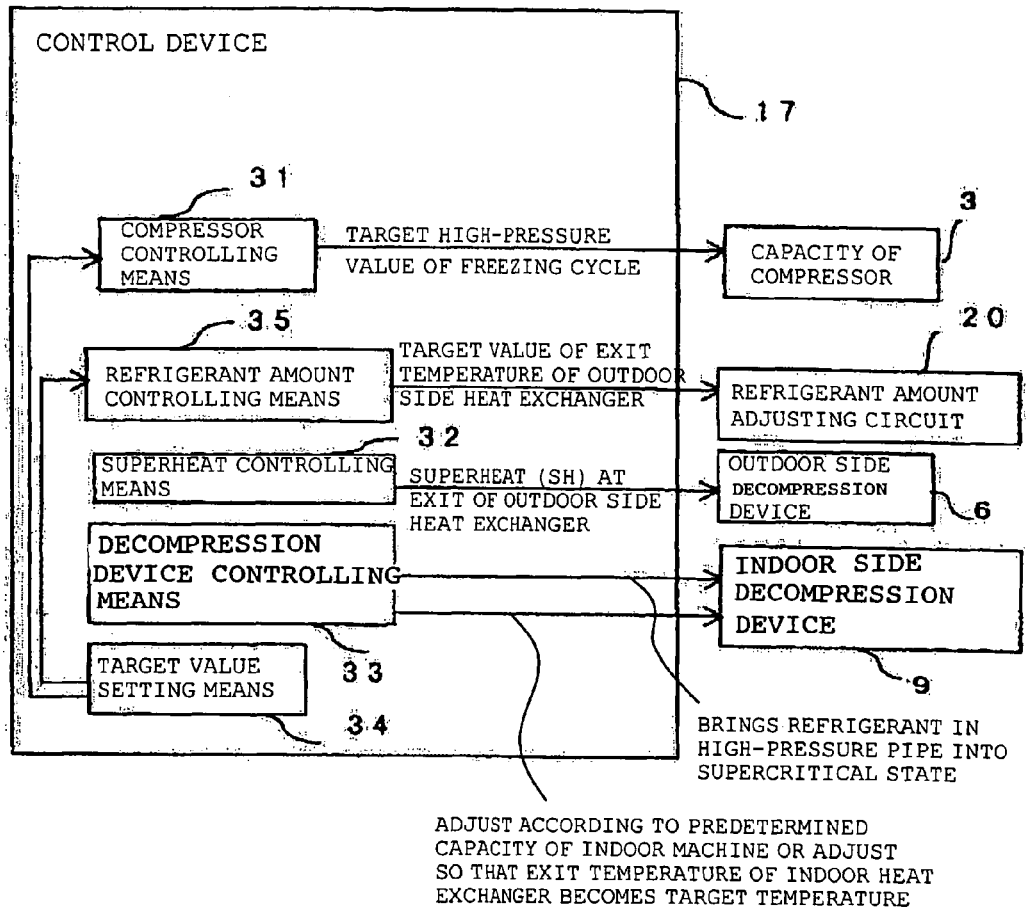
FIG. 8 is an explanatory diagram showing a configuration of the control device in a heating operation according to the first embodiment of the invention.
Figure 9:
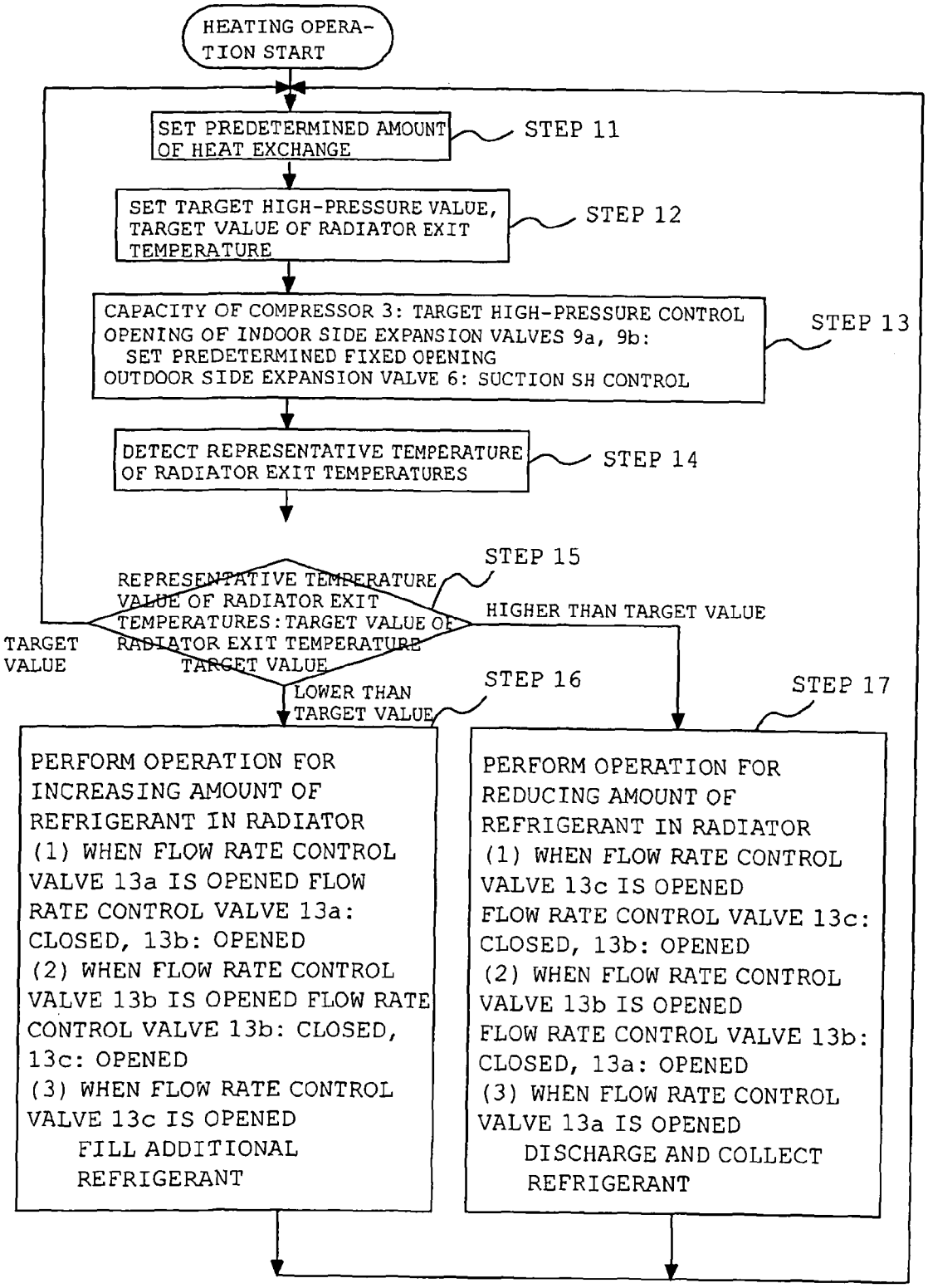
FIG. 9 is a flowchart showing a controlling action in the heating operation according to the first embodiment of the invention.

FIG. 8 shows a configuration of the control device 17 in the heating operation, and FIG. 9 is a flowchart showing the control action of the control device 17 in the heating operation. When the predetermined amount of heat exchange is determined (Step 11), the target value setting means 34 sets a combination of the target high-pressure value PK for realizing the determined amount of heat exchange at the maximal efficiency and the optimal radiator exit temperature (Step 12). Then, the operation is controlled with this value as the target value of control. The target value of control is set to fall within a certain range near the optimal value.

The compressor controlling means 31 performs the control of the number of revolution by the inverter. The capacity of operation of the compressor 3 is controlled so that the high-pressure value measured by the pressure sensor 15*a* becomes a value near the target high-pressure value PK set as described above, for example, 10 MPa.

The decompression device controlling means 33 adjusts the openings of the indoor side expansion valves 9*a*, 9*b* to be a variable resistance which is determined according to the predetermined capacity on the basis of the predetermined amounts of heat exchange of the respective indoor machines 2*a*, 2*b*. These openings are fixed openings. When the predetermined capacity of the indoor machine 2 is large, the fixed openings are set to be large values, and when the predetermined capacity of the indoor machine 2 is small, the fixed openings are set to small values. The respective fixed openings of the indoor side expansion valves 9*a*, 9*b* are determined so as to prevent the refrigerant at the indoor side expansion valves 9*a*, 9*b* from being significantly decompressed to a pressure lower than the critical pressure, for example, on the order of 0.5 MPa in the pressure difference. Therefore, the refrigerant in the high-pressure pipe of the refrigeration cycle, that is, the refrigerant flowing in the refrigerant pipe between the indoor side expansion valves 9*a*, 9*b* and the outdoor side expansion valve 6 becomes the supercritical state.

The opening of the outdoor side expansion valve 6 is controlled by the superheat controlling means 32 so that the refrigerant superheat of suction of the compressor 3 calculated by subtracting the saturation temperature of the refrigerant converted from the low-pressure value measured by the pressure sensor 15*b* from the temperature of the temperature sensor 16*f* becomes a target value. The target value used here is the predetermined target value, for example, 2° C. The amount of heat exchange of the outdoor side heat exchanger 5 and the amount of heat exchange of the indoor side heat exchangers 9*a*, 9*b* are controlled in a operation state in which the number of revolution of a fan or the flow-rate of a pump for transporting air or water as heat transfer medium are determined in advance. The opening of the flow-rate control valve 14 is controlled so that the superheat of the refrigerant at the low-pressure side exit of the high-low pressure heat exchanger 7 calculated by subtracting the saturation temperature of the refrigerant converted from the low-pressure measured by the pressure sensor 15*b* from the temperature of the temperature sensor 16*e* becomes a target value. The target value used here is a predetermined target value, for example, 5° C. This control process is shown in Step 13 in FIG. 9.

The temperature at the inlet port of the high-low pressure heat exchanger 7 during operation in this state is measured by the temperature sensor 16*d* (Step 14). Since this temperature indicates the temperature of the refrigerant at the exit of the respective indoor side heat exchangers 10 as the radiators which are mixed, it can be regarded as a representative temperature of the radiator exit temperature. The value of the radiator exit temperature and the target value of the radiator exit temperature set in the method described above are compared (Step 15). In examining the correlation between the radiator exit temperature and the amount of refrigerant, when the radiator exit temperature increases, the average temperature of the refrigerant in the entire radiator also increases and, in contrast, when it is lowered, the average temperature of the refrigerant of the entire radiator is lowered. On the other hand, since the density of the refrigerant is generally increased with decrease of the temperature. Therefore, when the radiator exit temperature is high, the amount of refrigerant existing in the radiator is small, and when the radiator exit temperature is low, the amount of refrigerant existing in the radiator increases.

Therefore, the amount of refrigerant of the radiator does not reach the required amount when the representative temperature of the measured radiator exit temperatures is higher than the target value of the radiator exit temperature. Therefore, the control is performed by the refrigerant amount controlling means 35 to increase the amount of refrigerant in the indoor side heat exchanger 10 which serves as the radiator (Step 16). In contrast, when the representative temperature of the measured temperature at the exits of the radiators is lower than the target value, the amount of refrigerant in the radiator exceeds the required amount. Therefore, the control is performed to reduce the amount of refrigerant in the indoor side heat exchanger 10 which serves as the radiator (Step 17). When the representative temperature of the radiator exit temperature measured by the comparison in Step 15 satisfies the target value, the procedure returns to Step 11.

The control of the amount of refrigerant in the indoor side heat exchanger 10 in the refrigerant amount controlling means 35 is performed in the same manner as the case of the cooling operation. When the representative temperature of the measured radiator exit temperature is higher than the target value, the control is performed to increase the amount of refrigerant in the indoor side heat exchanger 10 which serves as the radiator, and hence the density of the refrigerant stored in the refrigerant storage container 12 is lowered. Therefore, as shown in Step 16, when the flow rate control valve 13*a* is opened, the flow rate control valve 13*a* is closed and the flow rate control valve 13*b* is opened. When the flow rate control valve 13*b* is opened, the flow rate control valve 13*b* is closed and the flow rate control valve 13*c* is opened. When the flow rate control valve 13*c* is opened, the amount of the filled refrigerant is smaller than the required amount, and hence countermeasures such as additionally filling the refrigerant or reducing the capacity of the refrigerant storage container 12 are necessary.

The actual action of the flow rate control valve 13 is such that when the flow rate control valve 13*a* is opened, the flow rate control valve 13*a* is closed and the flow rate control valve 13*c* is opened so that the high-pressure low-temperature refrigerant stored in the refrigerant storage container 12 flows out to the low pressure side through the flow rate control valve 13*c* and the connecting pipe 18*c*. Subsequently, the flow rate control valve 13*c* is closed, and the flow rate control valve 13*b* is opened so that the high-temperature high-pressure refrigerant flows into the refrigerant storage container 12 through the flow rate control valve 13*b* and the connecting pipe 18*b* and is stored therein. When the flow rate control valve 13*b* is opened, the flow rate control valve 13*b* is closed and the flow rate control valve 13*c* is opened so that the high pressure high temperature refrigerant stored in the refrigerant storage container 12 flows out to the low-pressure side through the flow rate control valve 13*c* and the connecting pipe 18*c*, so that the refrigerant stored in the refrigerant storage container 12 becomes low-pressure and low-temperature. The timing of opening and closing the flow rate control valves 13*b*, 13*c* when replacing the high-pressure high-temperature refrigerant with the high-pressure low-temperature refrigerant may be controlled by detecting the temperature of the refrigerant storage container 12 by the temperature sensor 16*l* or may be set to open and close at a predetermined time in advance.

In contrast, when the representative temperature of the measured radiator exit temperatures is lower than the target value, the control is performed to reduce the amount of refrigerant in the indoor side heat exchanger 10 which serves as the radiator. Therefore, the density of the refrigerant to be stored in the refrigerant storage container 12 is increased. Therefore, as shown in Step 17, when the flow rate control valve 13*c* is opened, the flow rate control valve 13*c* is closed and the flow rate control valve 13*b* is opened, and when the flow rate control valve 13*b* is opened, the flow rate control valve 13*b* is closed, and the flow rate control valve 13*a* is opened. When the flow rate control valve 13*a* is opened, the amount of filled refrigerant is larger than the required amount, and hence countermeasures such as discharging and collecting the refrigerant from the device or increasing the capacity of the refrigerant storage container 12 are necessary.

As the actual action of the flow rate control valve 13 is such that when the flow rate control valve 13*c* is opened, the flow rate control valve 13*c* is closed and the flow rate control valve 13*b* is opened, so that the high-pressure high-temperature refrigerant is stored in the refrigerant storage container 12 through the flow rate control valve 13*b* and the connecting pipe 18*b*. When the flow rate control valve 13*b* is opened, the flow rate control valve 13*b* is closed and the flow rate control valve 13*c* is opened so that the high-pressure high-temperature refrigerant stored in the refrigerant storage container 12 flows out to the low-pressure side through the flow rate control valve 13*c* and the connecting pipe 18*c*. Subsequently, the flow rate control valve 13*c* is closed, and the flow rate control valve 13*a* is opened, so that the high-pressure low temperature refrigerant flows into the refrigerant storage container 12 through the flow rate control valve 13*a* and the connecting pipe 18*a* and is stored therein. In this case as well, the timing of opening and closing the flow rate control valves 13*a*, 13*c* when replacing the high-pressure low-temperature refrigerant with the high-pressure high-temperature refrigerant may be controlled by detecting the temperature of the refrigerant storage container 12 by the temperature sensor 16*l* or may be set so as to open and close at a predetermined time in advance.

In this manner, in the heating operation, by controlling the superheat at the exit of the heat exchanger which serves as the evaporator to be a predetermined value, the operation can be performed in a state in which the amount of refrigerant existing in the heat exchanger which serves as the evaporator is substantially constant. By adjusting the amount of refrigerant by the refrigerant amount adjusting circuit 20 in this state, the amount of refrigerant existing on the high-pressure side can be adjusted stably and quickly to control the operation.

By setting the target high-pressure value and the target radiator exit temperature respectively to control the capacity of the compressor and the amount of refrigerant, the required amount of heat exchange can be supplied from the indoor side heat exchanger 10. By setting the high-pressure target value to make a state to achieve the maximum coefficient of operation, an efficient operation can be realized, and the operation of the refrigerating air conditioning system in high-reliability and high efficiency can be realized.

In addition, by controlling the opening and closing of the flow rate control valves 13*a*, 13*b*, 13*c* to increase or decrease the amount of refrigerant in the radiator, the radiator exit temperature can be controlled to be a target value, so that the required amount of heat exchange can be reliably supplied by the radiator.

By controlling the opening of the outdoor side expansion valve 6 by the superheat controlling means 32, the superheat of suction of the compressor 3 which is substantially equal to the superheat of the refrigerant at the exit of the outdoor side heat exchanger 5 is controlled to be substantially constant, and hence the operation is controlled so that the amount of the refrigerant of the outdoor side heat exchanger 5 does not change. Since the liquid pipe 8 is controlled so that the high-pressure low-temperature refrigerant in the supercritical state always stays therein by the control of the opening of the indoor side expansion valves 9*a*, 9*b* and of the outdoor side expansion valve 6 performed by the decompression device controlling means 33, significant variations in amount of the refrigerant do not occur. Since the high-pressure high-temperature refrigerant in the supercritical state constantly exists in the gas pipe 11 as well, significant variations in amount of the refrigerant do not occur. Since the amount of refrigerant filled in the refrigerating air conditioning system is constant, when the amount of refrigerant in the refrigerant storage container 12 is varied, the influence is mainly reflected on the amount of refrigerant in the indoor side heat exchanger 10. In other words, the movement of the amount of refrigerant can be achieved so that the effect can be seen directly between the indoor side heat exchanger 10 and the refrigerant storage container 12, but the amount of refrigerant is not controlled by causing the state change in the evaporator as in the conventional device, the control of the amount of refrigerant can be achieved stably in a short time, and hence the operation of the refrigerating air conditioning system with higher efficiency can be achieved stably.

In the system described above, the representative value of the radiator exit temperatures used for adjusting the amount of refrigerant during the heating operation is the temperature sensed by the temperature sensor 16*d*. However, the representative temperature of the refrigerant can be determined on the basis of the refrigerant temperatures 16*h*, 16*j* at the exits of the respective indoor side heat exchangers 10*a*, 10*b* which serve as the radiators. At this time, it is preferable to obtain the representative refrigerant temperature by obtaining a weighted average according to the flow ratio of the refrigerant flowing in the respective indoor side heat exchangers 10*a*, 10*b*, and the weighted average is obtained on the basis of the ratio of opening of the indoor side expansion valves 9*a*, 9*b* which corresponds to the refrigerant flow ratio or the ratio of preset capacity of the indoor machines 2*a*, 2*b*, which correspond to the refrigerant flow ratio.

Since the temperatures at the exits of the plurality of radiators are not necessarily the same, the representative value of the temperature at the exits of the radiators may be determined by measuring or calculating the temperature which can be regarded as an average radiator exit temperature for the plurality of radiators during the operation. By adjusting the amount of refrigerant so that the representative value of the radiator exit temperature becomes the target radiator exit temperature, the required amount of heat exchange can be supplied and the efficient refrigeration cycle can be operated.

Although the control is performed so that the radiator exit temperature becomes the target value when adjusting the amount of refrigerant in the refrigerant storage container 12 by the refrigerant amount controlling means 35, it is also possible to set the target value of a high-pressure value and adjust the amount of refrigerant to obtain the high pressure target value.

For example, the capacity of the compressor 3 is controlled so that the representative value of the radiator exit temperature sensed by the temperature sensor 16*d* becomes the target radiator exit temperature determined from the amount of heat exchange required in the indoor side heat exchanger 10. Then, the amount of refrigerant is adjusted so that the high-pressure value sensed by the pressure sensor 15*a* becomes a high pressure target value set with the target value of the radiator exit temperature in Step 12 in FIG. 9. In this case, when the sensed high-pressure value is higher than the target high-pressure value, the amount of refrigerant existing in the indoor side heat exchanger 10 is too much. Therefore, the amount of refrigerant in the refrigerant storage container 12 is increased so that the amount of refrigerant existing in the indoor side heat exchanger 10 is reduced. In contrast, when the sensed high-pressure value is higher than the target high-pressure value, the amount of refrigerant existing in the indoor side heat exchanger 10 is small. Therefore, the amount of refrigerant in the refrigerant storage container 12 is reduced so that the amount of refrigerant existing in the indoor side heat exchanger 10 is increased. In this manner, the refrigerating air conditioning system with high efficiency and high reliability can be obtained also by controlling the amount of refrigerant existing in the high-pressure side.

In the heating operation, in the method of controlling the capacity of the compressor 3, the method of controlling the capacity may be changed according to the heating state on the load side as in the case of the cooling operation. For example, when the load side is an indoor space, and the air temperature in the indoor space is lower than the preset air temperature set by the user of the device, a larger amount of heat exchange than that at the current moment is required. Therefore, the predetermined amount of heat exchange of the indoor side heat exchanger 10 is changed to a larger value, and the target high-pressure value and the target value of the radiator exit temperature are corrected according to the change. In contrast, when the air temperature in the indoor space is higher than the preset air temperature, since the amount of the heat exchange is excessive at the current moment, the predetermined amount of heat exchange of the indoor side heat exchanger 10 is changed to a smaller value, and the target high-pressure value and the target value of the radiator exit temperature are corrected according to the change. With the control as such, the required amount of heat can reliably be obtained and the refrigerating air conditioning system which can be operated at high efficiency can be obtained.

As the method of controlling the capacity of the compressor 3, the capacity of the compressor 3 may be controlled directly on the basis of the heating state on the load side, such as the deviation between the preset air temperature and the air temperature in the indoor space without the intermediary of the predetermined amount of heat exchange of the indoor side heat exchanger 10 such as high pressure. For example, the capacity of the compressor 3 is increased, when the air temperature in the indoor space is lower than the preset air temperature, and the capacity of the compressor 3 is reduced when the air temperature in the indoor space is higher than the preset air temperature. When performing such heating operation, whether the amount of refrigerant in the radiator is large or small is determined from the correlation between the high-pressure and the radiator exit temperature to adjust the amount of refrigerant. For example, a correlation between the high-pressure and the radiator exit temperature, at which the coefficient becomes maximum from the capacity of the compressor 3 is determined in advance, then the radiator exit temperature obtained from the correlation is set as a target value, and then the amount of refrigerant in the radiator is adjusted so that the radiator exit temperature becomes this target value. With such control as well, the required amount of heat can be obtained reliably, and the refrigerating air conditioning system which is operated at high efficiency can be obtained.

The opening of the indoor-side expansion valve 9*a*, 9*b* is preferably controlled so that the state of the refrigerant in the pipe connecting the indoor side expansion valves 9*a*, 9*b* and the outdoor side expansion valve 6 becomes the supercritical state. By keeping the state of the refrigerant in the pipe connecting the indoor side expansion valves 9*a*, 9*b* and the outdoor side expansion valve 6 in the critical state, the operation can be performed while keeping the amount of refrigerant existing in the liquid pipe 8 constant. Therefore, by adjusting the amount of refrigerant in the radiator 10 to this state, the control of the amount of refrigerant can be performed stably in a short time, and hence the effects can be obtained more reliably.

The indoor side expansion valves 9*a*, 9*b* are respectively set in a range of the opening in which the refrigerant in the pipe connecting the indoor side expansion valves 9*a*, 9*b* and the outdoor side expansion valve 6 becomes the supercritical state, and the flow resistance is set to be a fixed opening determined from the predetermined capacity ratio on the basis of the predetermined amount of heat exchange of the indoor machines 2*a*, 2*b*. Therefore, the operation can be performed easily, and the refrigerant can be distributed according to the amounts of heat exchange of the indoor side heat exchangers 10*a*, 10*b* to a certain extent for circulation.

The openings of the indoor side expansion valves 9*a*, 9*b* may be changed as needed according to the operating state instead of the fixed openings. Although it is desirable to control the state of the refrigerant in the pipe connecting the indoor side expansion valves 9*a*, 9*b* and the outdoor side expansion valve 6 to be the supercritical state, there is a case in which the state of the refrigerant in the pipe connecting the indoor side expansion valves 9*a*, 9*b* and the outdoor side expansion valve 6 does not become the supercritical state depending on the operating state in the outdoor machine 1. Therefore, the openings of the indoor side expansion valves 9*a*, 9*b* and the outdoor side expansion valve 6 are controlled by the decompression device controlling means 33 so that the pressure measured by the pressure sensor 15*c* becomes at least the critical pressure. For example, when the pressure measured by the pressure sensor 15*c* is equivalent to or less than the critical pressure, the control to open the opening of the expansion valves is performed. In this manner, a stable operation can be achieved by controlling the openings of the indoor side expansion valves 9*a*, 9*b* so as to make the refrigerant flowing in the liquid pipe 8 in the supercritical state, by changing those openings, that is, the flow resistance.

It is also possible to employ the configuration in which the openings of the indoor side expansion valves 9*a*, 9*b* are changed as needed according to the operating state, set the indoor side expansion valves 9*a*, 9*b* respectively within a range of the openings with which the state of the refrigerant in the pipe connecting the indoor side expansion valves 9*a*, 9*b* and the outdoor side expansion valve 6 becomes the supercritical state, and make correction as follows.

For example, the temperature of the refrigerant at the exits of the respective indoor side heat exchangers 10*a*, 10*b* measured by the temperature sensors 16*h*, 16*j* and the temperature at the inlet port of the high-low pressure heat exchanger 7 measured by the temperature sensor 16*d*, that is, the representative radiator exit temperature are compared, and the openings are corrected on the basis of the result of comparison. When the deviation between the temperatures at the exits of the respective indoor side heat exchangers 10*a*, 10*b* and the representative radiator exit temperature is not large, for example, on the order of 5° C. or below, it is not necessary to change the openings of the indoor side expansion valves 9*a*, 9*b*. On the other hand, when the temperature deviation is significant, for example, larger than 5° C., the openings of the respective indoor side expansion valves 9*a*, 9*b* are controlled so as to be a predetermined temperature difference, for example, within 5° C. For example, in a case in which the refrigerant temperature at the exit of the indoor side heat exchanger 10*a* is higher than the representative radiator exit temperature by a temperature equivalent to or more than a predetermined temperature, and the refrigerant temperature at the exit of the indoor side heat exchanger 10*b* is lower than the representative radiator exit temperature by a temperature equivalent to or more than a predetermined temperature, the average refrigerant temperature of the indoor side heat exchanger 10*a* is high, the amount of heat exchange is larger than the predetermined amount, the average refrigerant temperature of the indoor side heat exchanger 10*b* is low, and the amount of the heat exchange is smaller than the predetermined value. In such a case, the capability of the indoor side heat exchanger 10*b* is inefficient, and hence the change of the opening is necessary. Since the flow rate of the refrigerant flowing in the indoor side heat exchanger 10*a* is large and the flow rate of the refrigerant flowing in the indoor side heat exchanger 10*b* is small, the opening of the indoor side expansion valve 9*a* is controlled to be smaller and the opening of the indoor side expansion valve 9*b* is controlled to be large. Explaining by a general control method, the opening of the indoor side expansion valve 9 is reduced when the refrigerant temperature at the exit of the indoor side heat exchanger 10 is higher than the representative radiator exit temperature by more than a predetermined temperature, and the opening of the indoor side expansion valve 9 is increased when the refrigerant temperature at the exit of the indoor side heat exchanger 10 is lower than the representative radiator exit temperature by more than the predetermined temperature.

By providing the plurality of indoor machines 2 and controlling the openings of the indoor expansion valves 9*a*, 9*b* respectively, the excess and deficiency of the amount of heat exchange of the indoor side heat exchanger 10 with respect to the predetermined amount can be solved, and hence the refrigerating air conditioning system which can supply the well balanced and adequate amount of heat exchange to each of the plurality of indoor side heat exchangers 10 can be obtained.

In the multiple-type refrigerating air conditioning system having in particular a configuration in which a plurality of indoor machines 2 are connected, the method of controlling the amount of refrigerant described above is effective in the following points. In general, in the case of the device of the multiple type, the pipes 8, 11 connecting the outdoor machine 1 and the indoor machines 2 are long. Therefore, the amount of refrigerant filled in the device is large. On the other hand, since the operation is stopped in the respective indoor machines 2, the variations in the amount of refrigerant according to the operating conditions increase so that the operation becomes unstable, and the operation with the optimal amount of refrigerant can hardly be performed so that the efficiency of operation can easily be lowered. In particular, when the state of the connecting pipe is in the vapor-liquid two-phase state, a large variation in amount of the refrigerant tends to occur due to the variation in liquid amount existing therein. In the device of the multiple type in which the length of the pipe is long, larger variation in refrigerant amount is resulted. In this embodiment, the superheat at the exit of the evaporator is controlled to be a predetermined value and the state of the refrigerant in the connecting pipe is controlled to be the supercritical state, even under these conditions. In other words, since the variation of the amount of refrigerant can be controlled to be small, the operation can easily be stable, and the operation with the optimal amount of refrigerant can easily be realized, so that the operation at high efficiency is achieved.

The control of the indoor machine side expansion valve 9 in the control according to this embodiment can be applied generally, irrespective of the capacities or the mode of the indoor machines 2. At the same time, the control of the compressor 3, the expansion valve 6, the amount of refrigerant on the outdoor machine 1 side can be implemented generally, irrespective of the capacity or the mode of the indoor machines 2. Therefore, the control does not have to be changed even in a case in which an unspecified indoor machine 2 is connected to the outdoor machine 1 assuming the multiple type device, and hence flexible constitution of the device can easily be realized, and hence it can be used further generally.

In this embodiment, the cooling and heating operation is realized by switching the flow path of the four-way valve 4, and hence the low temperature refrigerant in the supercritical state can be supplied to the refrigerant storage container 12 both in the cooling and heating operations, by the control of the opening of the outdoor side expansion valve 6, and the indoor side expansion valve 9. Therefore, the amount of refrigerant can be adjusted by the same control both in the cooling and heating operations, so that the high-efficiency operation can be realized, and the simplification of the control is achieved.

In particular, in the refrigerating air conditioning system which performs cooling and heating, the amount of refrigerant required for the cooling operation and the heating operation is different from each other. In such a case, it is necessary to store the excessive refrigerant and replenish the deficient refrigerant, and hence the effects of the refrigerant storage circuit 20 in this embodiment are significant.

In this embodiment, since the amount of refrigerant is adjusted by the difference in density among the high-pressure high-temperature refrigerant, the high-pressure low-temperature refrigerant, and the low-pressure low temperature refrigerant, the margin of the amount of refrigerant which can be adjusted may be widened. In particular, since the low-temperature refrigerant having a large density can be stored in the refrigerant storage container 12, a large amount of the refrigerant can be stored. Contrary speaking, the amount of refrigerant can be adjusted with the refrigerant storage container 12 of a small size. Therefore, downsizing of the refrigerant storage container 12, and in association thereto, cost reduction can be achieved.

The capacity of the refrigerant storage container 12 provided in this embodiment is on the order of 10 litters in the case in which the amount of filled refrigerant is on the order of 20 kg. When the refrigerant is $CO_2$, for example, the density of the high-pressure low-temperature refrigerant is on the order of 700 kg/m$^3$, the density of the high-pressure high-temperature refrigerant is on the order of 150 kg/m$^3$, and the density of the low-pressure low-temperature refrigerant is on the order of 100 kg/m$^3$, and the amount of refrigerant which can be stored in the refrigerant storage container 12 can be adjusted stepwise to 7 kg, 1.5 kg, and 1 kg.

In this manner, with the provision of the refrigerant amount adjusting circuit 20 comprising the refrigerant storage container 12 as well as the high-pressure low-temperature refrigerant connecting pipe 18*a* which can connect and disconnect the refrigerant pipe between the outdoor side expansion valve 6 and the indoor expansion valve 9 to the refrigerant storage container 12, and the low-pressure low-temperature refrigerant connecting pipe 18*c* which can connect and disconnect the refrigerant storage container 12 to the suction side of the compressor 3, it is configured to be able to store the refrigerants in different densities in the refrigerant storage container 12. In particular, by storing the high-pressure low temperature refrigerant, a large amount of refrigerant can be stored, and by storing the low-pressure low-temperature refrigerant, a small amount of refrigerant can be stored, so that the range of the amount of stored refrigerant can be widened.

In addition, with the further addition of the high-pressure high-temperature refrigerant connecting pipe 18*b*, which can connect and disconnect the refrigerant storage container 12 and the discharge side of the compressor 3, to the refrigerant amount adjusting circuit 20, the three steps of the amount of refrigerant can be stored in the refrigerant storage container 12, and hence the amount of refrigerant existing in the radiator can be controlled in three-steps.

Furthermore, the refrigerant amount controlling means 35 can control the amount of refrigerant existing in the radiator quickly by the following way. When the amount of refrigerant existing in the heat exchanger which serves as the radiator is small, the high-pressure low temperature refrigerant connecting pipe 18*a* is disconnected and the high-pressure high-temperature refrigerant connecting pipe 18*b* or the low-pressure and low temperature refrigerant connecting pipe 18*c* is connected so that the refrigerant of low density is stored in the refrigerant storage container 12, and when the amount of refrigerant existing in the heat exchanger which serves as the radiator is large, the high-pressure low temperature refrigerant connecting pipe 18*a* or the high-pressure high-temperature refrigerant connecting pipe 18*b* is connected and the low-pressure low temperature refrigerant connecting pipe 18*c* is disconnected so that the refrigerant of a high density is stored in the refrigerant storage container 12.

As shown in the operation control procedure in FIG. 5 and FIG. 9, the refrigerant is circulated through the compressor, the radiator, the decompression device and the evaporator so as to constitute the refrigeration cycle, and the procedure includes a refrigerating air conditioning step for performing the refrigerating air conditioning by the evaporator or the radiator, by operating the high-pressure side between the discharging side of the compressor and the inlet port of the decompression device at a pressure higher than the critical pressure, and operating the low-pressure side between the exit of the decompression device and the inlet port of the compressor at a pressure lower than the critical pressure; a superheat controlling step for controlling the superheat at the exit of the evaporator to a predetermined value (step 1, Step 13); and an amount-of-refrigerant controlling step for adjusting the amount of refrigerant existing in the radiator, by storing the excessive refrigerant in the refrigerant storage means 12 which can be connected and disconnected to/from the refrigeration cycle (Steps 5, 6, 16, 17). Thereby, in the refrigerating air conditioning system employing the refrigerant such as $CO_2$ used in the supercritical area, a method of controlling the operation of the refrigerating air conditioning system which achieves the efficient operation by adjusting the amount of refrigerant in the radiator to contribute to the efficiency of the device stably and quickly.

As shown in FIG. 9, a target setting step for setting a target high-pressure value and a target value of the radiator exit refrigerant temperature to obtain the amount of heat required in the radiator (Step 12) and a compressor controlling step for controlling the capacity of the compressor so that the high pressure value of the circulating refrigerant becomes the target high pressure value (Step 13) are provided, and in the refrigerant amount controlling steps (Step 16, 17), heat is supplied by the radiator while adjusting the amount of refrigerant so that the temperature of the circulating refrigerant at the radiator exit becomes the target refrigerant temperature at the radiator exit and is used. Whereby, the operation controlling method of the refrigerating air conditioning system, in which the amount of refrigerant in the radiator contributing to the efficiency of the device is adjusted stably and quickly to use the heat efficiently and the required amount of heat can be obtained, is obtained.

As shown in FIG. 5, a target setting step for setting the target high pressure value (Step 3) is provided, and in the refrigerant amount controlling step (Steps 5, 6), cold heat is supplied by the evaporator and is used while adjusting the amount of refrigerant so that the high pressure value of the circulating refrigerant becomes the high pressure target value. Whereby, the operation controlling method of the refrigerating air conditioning system, in which the amount of refrigerant in the radiator contributing to the efficiency of the device is adjusted stably and quickly efficient to use cold heat efficiently, is obtained.

Further, the compressor controlling step for controlling the capacity of the compressor so as to make the low-pressure value of the circulating refrigerant become a predetermined value is provided (Step 1). Whereby the operation controlling method of the refrigerating air conditioning system, in which the amount of cold heat required in the heat exchanger on the user side can be reliably secured, is obtained.

The compressor controlling step for controlling the capacity of the compressor for obtaining the amount of cold heat required in the evaporator is provided. Whereby the operation controlling method of the refrigerating air conditioning system, in which the amount of cold heat required in the heat exchanger on the user side can be reliably secured, is obtained.

The control of the indoor side expansion valve 9 for controlling the superheat at the exit of the indoor side heat exchanger 10 during the cooling operation and the control of the outdoor side expansion valve 6 for controlling the superheat at the suction port of the compressor 3 during the heating operation are preferably performed at intervals shorter than the control intervals for adjusting the control of the amount of refrigerant in the refrigerant storage container 12. As described above, the control of the superheat has a function to prevent the amount of refrigerant in the heat exchanger which serves as the evaporator from varying. Therefore, by adjusting the control of the amount of refrigerant in the refrigerant storage container 12 after having performed the control of the superheat more than a predetermined number of times to stabilize the superheat to a certain degree, the amount of refrigerant existing in the heat exchanger which serves as the radiator is stabilized at that moment, and the high-pressure value and the radiator exit temperature according to the amount of refrigerant can be obtained, so that the control of the amount of refrigerant in the refrigerant storage container 12 can be performed more adequately. Therefore, further stable operation of the device can be realized.

When the capacity of the compressor 3 is controlled as well, the superheat of the heat exchanger which serves as the evaporator varies, and hence the amount of refrigerant varies. Therefore, by controlling the amount of refrigerant after having performed the capacity control of the compressor 3 at intervals shorter than the interval of the refrigerant amount control to stabilize the amount of refrigerant of the heat exchanger which serves as the evaporator, further stable operation of the device can be realized.

For example, the interval of the superheat control and the capacity control of the compressor by the respective expansion valves is set to the range from 30 seconds to one minute and the interval of the refrigerant amount control is set to an interval longer than the above described interval, such as from three minutes to five minutes.

In this manner, by setting the interval of the capacity control of the compressor performed in the compressor controlling step to be shorter than the interval of the refrigerant amount adjusting control performed in the refrigerant amount controlling step, the operation controlling method of the refrigerating air conditioning system which achieves a stable operation is obtained.

By setting the interval of the control of the superheat at the exit of the evaporator performed in the superheat controlling step to be shorter than the interval of the refrigerant amount adjustment control performed in the refrigerant amount controlling step, the operation controlling method of the refrigerating air conditioning system which achieves a stable operation can be obtained.

Figure 10:
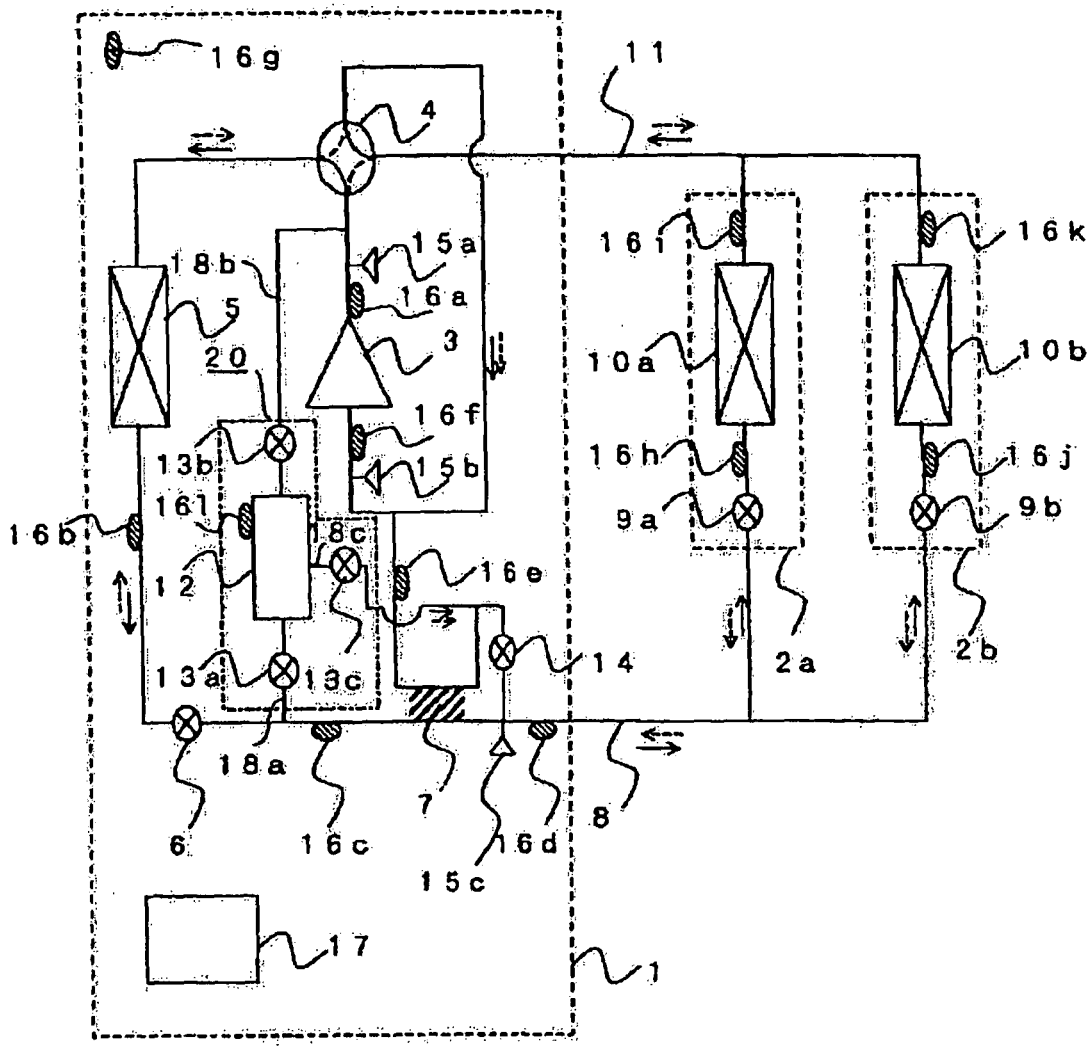
FIG. 10 is a refrigerant circuit diagram of the refrigerating air conditioning system according to the first embodiment of the invention.

Although the temperature adjusting heat exchange unit for adjusting the temperature of the refrigerant flowing in the pipe for connecting the indoor side expansion valve 9 and the outdoor side expansion valve 6 has a circuit configuration in which the refrigerant in the refrigerant storage container 12 is discharged to the suction side of the compressor 3 via the flow rate control valve 13*c* in FIG. 1, it is also possible to employ a configuration in which it is discharged to the inlet port on the low-pressure side of the high-low heat exchanger 7 as shown in FIG. 10. Even in the case where the refrigerant staying in the refrigerant storage container 12 is in the supercritical state, if it is the low-temperature refrigerant and is discharged to the suction side of the compressor 3 as is, it is converted into the vapor-liquid two phase state when decompressed to a low pressure. Hence, liquid returns to the compressor 3 during operation, which is a problem in terms of reliability of the operation of the compressor 3. When it is configured to discharge the refrigerant in the refrigerant storage container 12 to the inlet port on the low-pressure side of the high-low pressure heat exchanger 7, heat exchange is performed in the high-low pressure heat exchanger 7, the low-pressure refrigerant is heated, and the liquid refrigerant is evaporated, so that the operation in which the liquid returns to the compressor 3 can be avoided, and hence the reliability of the operation of the compressor 3 can be improved.

Second Embodiment

Hereinafter, a second embodiment of the invention will be described. The circuit configuration, the control of the compressor 3, the four-way valve, the outdoor side expansion valve 6, the indoor side expansion valve 9, and the flow-rate control valve 14 for utilizing cold heat and heat, in the second embodiment are the same as in the first embodiment. Therefore, another configuration and operation of the refrigerant amount adjusting circuit, that is, another embodiment of the refrigerant amount adjustment of the refrigerant storage container 12 will be described here.

As in the first embodiment, a refrigerant amount adjusting circuit is configured with a refrigerant storage container 12, a connecting pipe 18*a* having a flow rate control valve 13*a* as a high-low pressure refrigerant connecting pipe which can connect and disconnect the refrigerant pipe between the heat source side decompression device 6 and the user-side decompression device 9 to the refrigerant storage container 12, a connecting pipe 18*b* having a flow rate control valve 13*b* as a high-pressure high-temperature refrigerant connecting pipe which can connect and disconnect the refrigerant storage container 12 to the discharge side of the compressor 3, and a connecting pipe 18*c* having the flow rate control valve 13*c* as a low-pressure low-temperature refrigerant connecting pipe which can connect and disconnect the refrigerant storage container 12 to the suction side of the compressor 3.

As show in the first embodiment, the amount of refrigerant in the refrigerant storage container 12 is adjusted for adjusting the amount of refrigerant in the radiator. In the first embodiment, the refrigerants in the three state; the high-pressure low-temperature refrigerant, the high-pressure high-temperature refrigerant, and the low-pressure low temperature refrigerant are stored in the refrigerant storage container 12, so that the amount of refrigerant existing in the radiator can be adjusted in three-steps. With the configuration of this embodiment, the refrigerant in further more states can be stored in the refrigerant storage container 12, so that the amount of refrigerant existing in the radiator can be varied in multiple stages continuously.

At least the flow rate control valves 13*a*, 13*b* for allowing passage of the high-pressure refrigerant out of the flow rate control valves 13*a*, 13*b* and 13*c* are configured to be capable of varying the opening such as an electromagnetic valve so that the amount of refrigerant flowing into the refrigerant storage container 12 thorough the respective flow rate control valves 13*a*, 13*b* and 13*c* is arbitrarily changed. Accordingly, the amount of refrigerant to be stored in the refrigerant storage container 12 can be controlled continuously. When all the flow rate control valves 13*a*, 13*b* and 13*c* are opened, the high-pressure low-temperature refrigerant flows into the refrigerant storage container 12 via the flow rate control valve 13*a* and high-pressure high-temperature refrigerant flows into the refrigerant storage container 12 via the flow rate control valve 13*b*. Then, these refrigerants are mixed and filled in the refrigerant storage container 12, and hence the refrigerant storage container 12 is filled with the high-pressure refrigerant, and then the high-pressure refrigerant flows out to the suction side of the compressor via the flow rate control valve 13*c* by the pressure difference at that time. The refrigerant temperature in the refrigerant storage container 12 is determined by the flow ratio between the high-temperature refrigerant and the low-temperature refrigerant flowing therein. The lower the refrigerant temperature in the refrigerant storage container 12 is, the higher the refrigerant density becomes and hence a larger amount of refrigerant can be stored. Therefore, in order to increase the amount of refrigerant existing in the refrigerant storage container 12, the control is performed to achieve the ratio of the opening of the flow rate control valve 13*a* larger than the flow rate control valve 13*b*, so that a large amount of low-temperature refrigerant flows into the refrigerant storage container 12, and hence the refrigerant temperature in the refrigerant storage container 12 is lowered. In contrast, in order to reduce the amount of refrigerant existing in the refrigerant storage container 12, the control is performed to achieve the ratio of the opening of the flow rate control valve 13*b* larger than the flow rate control valve 13*a*, so that a large amount of high-temperature refrigerant flows into the refrigerant storage container 12 and hence the refrigerant temperature in the refrigerant storage container 12 is increased. With such an operation, the temperature in the refrigerant storage container 12 can be continuously controlled by the ratio of the opening between the flow rate control valves 13*a*, 13*b*, and hence the amount of refrigerant in the refrigerant storage container 12 can be controlled continuously, whereby the amount of refrigerant in the radiator can be adjusted more finely.

Then, when the flow rate control valves 13*b*, 13*c* are adjusted to adequate openings respectively in the state in which the low-pressure low-temperature refrigerant is stored in the refrigerant storage container 12, the high-pressure high-temperature refrigerant flows therein through the flow rate control valve 13*b*. In other words, the state of the refrigerant to be stored in the refrigerant storage container 12 can be varied continuously or in multiple stages in the range from the low-pressure low-temperature refrigerant to the high-pressure high-temperature refrigerant.

Since the temperature of the refrigerant stored in the refrigerant storage container 12 can be measured by the temperature sensor 16*l*, the ratio of the openings of the flow rate control valves 13*a*, 13*b* and 13*c* can be controlled on the basis of the measured value.

Both of the flow rate control valves 13*a*, 13*b* do not necessarily have to be opening-variable. Even though one of them is opening-fixed valve, the ratio of the openings of the flow rate control valves 13*a*, 13*b* can be controlled continuously by controlling the opening of the opening-variable valve.

The flow rate control valve 13*c* may be openable and closable, or may be kept at a fixed opening. For example, it may be kept at an opening at which the refrigerant circulating in the refrigeration cycle is not bypassed to the low-pressure side through the refrigerant storage container 12, so that about 1% of the refrigerant can constantly flow through the flow rate control valve 13*c*. In this case as well, when the flow rate control valves 13*a*, 13*b* are both closed, the low-pressure low-temperature low-density refrigerant is stored in the refrigerant storage container 12 through the flow rate control valve 13*c*.

When the flow rate control valve 13 is configured to be an opening-variable valve such as an electromagnetic valve and the amount of refrigerant flowing into the refrigerant storage container 12 through the respective flow rate control valves 13*a*, 13*b* and 13*c* is varied arbitrarily, the amount of refrigerant can be adjusted further finely. As another method for adjusting the amount of refrigerant in the refrigerant storage container 12, it is also possible to provide a pressure sensor in the refrigerant storage container 12 to measure the pressure in the refrigerant storage container 12 and control the pressure. When the flow rate control valves 13*a*, 13*b* and 13*c* are opened, the pressure in the refrigerant storage container 12 is determined by the ratio of the opening of the control valves 13*a*, 13*b* on the flow-in side and the control valve 13*c* on the flow-out side. When the openings of the flow rate control valves 13*a*, 13*b* are larger than the opening of the flow rate control valve 13*c*, the pressure in the refrigerant storage container 12 becomes high which is a pressure closer to the high-pressure. In contrast, when the opening of the flow rate control valve 13*c* is larger than the openings of the flow rate control valves 13*a*, 13*b*, the pressure in the refrigerant storage container 12 becomes low which is a pressure closer to the low-pressure. The higher the refrigerant pressure is, the more the amount of refrigerant in the refrigerant storage container 12 becomes. Therefore, when it is desired to control the amount of refrigerant existing in the refrigerant storage container 12 to be large, the opening is controlled so that the ratio of the openings of the flow rate control valves 13*a*, 13*b* become larger than the flow rate control valve 13*c* to increase the pressure in the refrigerant storage container 12. In contrast, when it is desired to control the amount of refrigerant in the refrigerant storage container 12 to be small, the opening is controlled so that the ratio of the opening of the flow rate control valve 13*c* is larger than the flow rate control valves 13*a*, 13*b* to decrease the pressure in the refrigerant storage container 12. With such an operation, the pressure in the refrigerant storage container 12 can be continuously controlled by the ratio of the flow rate control valves 13*b*, 13*c*, and the amount of refrigerant in the refrigerant storage container 12 can also be controlled continuously, whereby the amount of refrigerant can be adjusted further finely.

For example, in the configuration which is the same as the first embodiment, that is, when the capacity of the refrigerant storage container 12 is on the order of 10 litters and the refrigerant is $CO_2$, for example, the density of the high-pressure low-temperature refrigerant is on the order of 700 kg/m$^3$, the density of the high-pressure high-temperature refrigerant is on the order of 150 kg/m$^3$, and the density of the low-pressure low temperature refrigerant is on the order of 100 kg/m$^3$, so that the amount of refrigerant which can be stored in the refrigerant storage container 12 can be adjusted finely and continuously between 7 kg to 1 kg.

For example, in the heating operation, when the refrigerating air conditioning is performed in the indoor side heat exchanger 10 by circulating the refrigerant through the compressor 3, the indoor side heat exchanger 2 which serves as the radiator, the outdoor side decompression device 6, and the outdoor side heat exchanger 5 which serves as the evaporator, there are provided a high-pressure high-temperature refrigerant storing step for storing the high-pressure high-temperature refrigerant in the refrigerant storage container 12 by causing the high-pressure high-temperature refrigerant flowing in the refrigerant pipe from the discharge port of the compressor 3 to the inlet port of the indoor side heat exchanger 10 to flow into the refrigerant storage container 12, a high-pressure low-temperature refrigerant storing step for storing the high-pressure low-temperature refrigerant in the refrigerant storage container 12 by causing the high-pressure low-temperature refrigerant flowing in the refrigerant pipe from the exit of the indoor side heat exchanger 10 to the inlet port of the outdoor side decompression device 6 to flow into the refrigerant storage container 12, and a low-pressure low-temperature refrigerant storing step for causing the high-pressure refrigerant stored in the refrigerant storage container 12 to flow out to the suction side of the compressor 3, and the refrigerants in different densities are stored in the refrigerant storage container 12, so that the amount of refrigerant to be circulated is controlled. In the cooling operation, when the refrigerating air conditioning is preformed by the indoor side heat exchanger 2 by circulating the refrigerant through the compressor 3, the outdoor side heat exchanger 5 which serves as the radiator, the indoor side decompression device 9, and the outdoor side heat exchanger 5 which serves as the evaporator, there are provided a high-pressure high-temperature refrigerant storing step for storing the high-pressure high-temperature refrigerant in the refrigerant storage container 12 by causing the high-pressure high-temperature refrigerant flowing in the refrigerant pipe from the discharge port of the compressor 3 to the inlet port of the outdoor side heat exchanger 5 to flow into the refrigerant storage container 12, a high-pressure low-temperature refrigerant storing step for storing the high-pressure low-temperature refrigerant in the refrigerant storage container 12 by causing the high-pressure low-temperature refrigerant flowing in the refrigerant pipe from the exit of the indoor side heat exchanger 10 to the inlet port of the outdoor side decompression device 6 to flow into the refrigerant storage container 12, and a low-pressure low-temperature refrigerant storing step for causing the high-pressure refrigerant stored in the refrigerant storage container 12 to flow out to the suction side of the compressor 3, and the refrigerants in multiple steps of density are stored in the refrigerant storage container 12, so that the amount of refrigerant to be circulated is controlled. Accordingly, the amount of refrigerant existing in the radiator can be quickly increased or decreased so that the operation in high efficiency is achieved.

The refrigerant amount control as described above can also be applied to the cooling operation using cold heat.

When a step of setting the high-pressure side of the circulating refrigerant to a critical pressure area is provided in the refrigerant amount control as described above, the range of the density of the refrigerant can be increased with the high-pressure high-temperature refrigerant and the low-pressure low-temperature refrigerant, so that a large amount of refrigerant can be stored when the refrigerant in the supercritical state is stored. Therefore, a large amount of refrigerant can be stored even in the small refrigerant storage container 12, in other words, the refrigerant storage container 12 can be downsized.

In addition, by adjusting the openings of the flow rate control valve 13*a* and the flow rate control valve 13*b*, and changing the ratio of the amount of high-pressure high-temperature refrigerant stored in the refrigerant storage container 12 in the high-pressure high-temperature refrigerant storing step and the amount of high-pressure low-temperature refrigerant stored in the refrigerant storage container 12 in the high-pressure low-temperature refrigerant storing step to change the density of the refrigerant stored in the refrigerant storage container 12 continuously, the control can be performed finely with good followability according to the operating state of the refrigerating air conditioning system, whereby the operation with high efficiency can be achieved.

As another method of adjusting the amount of refrigerant in the refrigerant storage container 12, an example to control the temperature in the refrigerant storage container 12 by controlling the temperature of the high-pressure low-temperature refrigerant flowing through the flow rate control valve 13*a* will be described below.

The high-low pressure heat exchanger 7, in the heating operation for example, is provided on the upstream side of the connecting portion between the high-pressure low-temperature refrigerant connecting pipe 18*a* provided with the flow rate control valve 13*a* and the refrigerant pipe of the refrigeration cycle, and serves as a temperature adjusting heat exchange unit for adjusting the temperature of the refrigerant flowing in the connecting portion. When the flow rate control valve 13*a* is opened during the heating operation, the refrigerant after having been subjected to the heat exchange and hence cooled in the high-low pressure heat exchanger 7 flows into the refrigerant storage container 12. Therefore, the temperature of the refrigerant in the refrigerant storage container 12 can be controlled by controlling the amount of heat exchange of the high-low pressure heat exchanger 7. The amount of the heat exchange of the high-low pressure heat exchanger 7 is determined by the flow rate of the refrigerant bypassing via the flow rate control valve 14, and when the flow rate of the bypassing refrigerant is small, the amount of heat exchange is also small, and when the flow rate of the bypassing refrigerant is large, the amount of the heat exchange is also large. Therefore, when it is desired to control the amount of refrigerant in the refrigerant storage container 12 to be large, the opening of the flow rate control valve 14 is increased to increase the flow rate of the bypassing refrigerant and increase the amount of heat exchange in the high-low pressure heat exchanger 7. Then, the refrigerant temperature at the exit of the high-low pressure heat exchanger 7 is lowered, and hence the refrigerant temperature in the refrigerant storage container 12 is also lowered and the amount of refrigerant stored in the refrigerant storage container 12 is increased. In contrast, when it is desired to control the amount of refrigerant in the refrigerant storage container 12 to be small, the opening of the flow rate control valve 14 is reduced to reduce the flow rate of the bypassing refrigerant and reduce the amount of heat exchange in the high-low pressure heat exchanger 7. Accordingly, the refrigerant temperature at the exit of the high-low pressure heat exchanger 7 increases, and hence the refrigerant temperature in the refrigerant storage container 12 also increases, and the amount of refrigerant stored in the refrigerant storage container 12 is reduced.

In this case, although the flow rate control valve 13*c* on the low-pressure side is necessary for causing the refrigerant in the refrigerant storage container 12 to flow in and flow out, the flow rate control valve 13*b* on the high-pressure high-temperature side does not necessarily have to be provided.

Since the refrigerant temperature flowing into the refrigerant storage container 12 is measured by the temperature sensor 16*c*, it is also possible to determine a target amount of refrigerant in the refrigerant storage container 12, set the refrigerant temperature determined from the amount of refrigerant as a target value, and control the opening of the flow rate control valve 14 so that the temperature measured by the temperature sensor 16 becomes the target value.

Here, the high-low pressure heat exchanger 7 as the temperature adjusting heat exchanging unit, which is means for adjusting the temperature of the refrigerant flowing in the pipe connecting the indoor side expansion valve 9 and the outdoor side expansion valve 6 is adapted to adjust the temperature of the refrigerant flowing into the refrigerant storage container 12 by exchanging heat between the refrigerant flowing on the upstream side of the connecting portion to the refrigerant storage container 12 and part of the refrigerant obtained by branching therefrom and decompressed to a low-temperature. Therefore, the temperature of the refrigerant flowing into the refrigerant storage container 12 can be adjusted finely and continuously with a simple circuit, and hence the refrigerating air conditioning system in which a stable operation control is achieved and highly efficient operation is performed, is obtained.

In this embodiment as well, as shown in FIG. 10, a configuration, in which the refrigerant stored in the refrigerant storage container 12 is discharged to the inlet port on the low-pressure side of the high-low pressure heat exchanger 7, is also applicable. The operation in which liquid is returned to the compressor 3 can be avoided by performing heat exchange with respect to the refrigerant flowing out from the refrigerant storage container 12 by the high-low pressure heat exchanger 7 and heating the low-pressure two-phase refrigerant, whereby the reliability in operation of the compressor 3 can be improved.

Although in FIG. 1, the means for adjusting the temperature of the refrigerant flowing into the refrigerant storage container 12 are the refrigerant pipe between the outdoor side expansion valve 6 and the indoor side expansion valve 9, on the high-pressure side of the high-low pressure heat exchanger 7, and the refrigerant pipe for the refrigerant branched from a part of the high-pressure side and decompressed on the lower pressure side, other configuration are also applicable, and means other than the high-low pressure heat exchanger 7 may be employed. For example, it is also possible to provide an internal heat exchanger to control the amount of heat exchange, or to provide a heat exchanger for performing heat exchange with other heat source such as air to control the amount of heat exchange.

Figure 11:
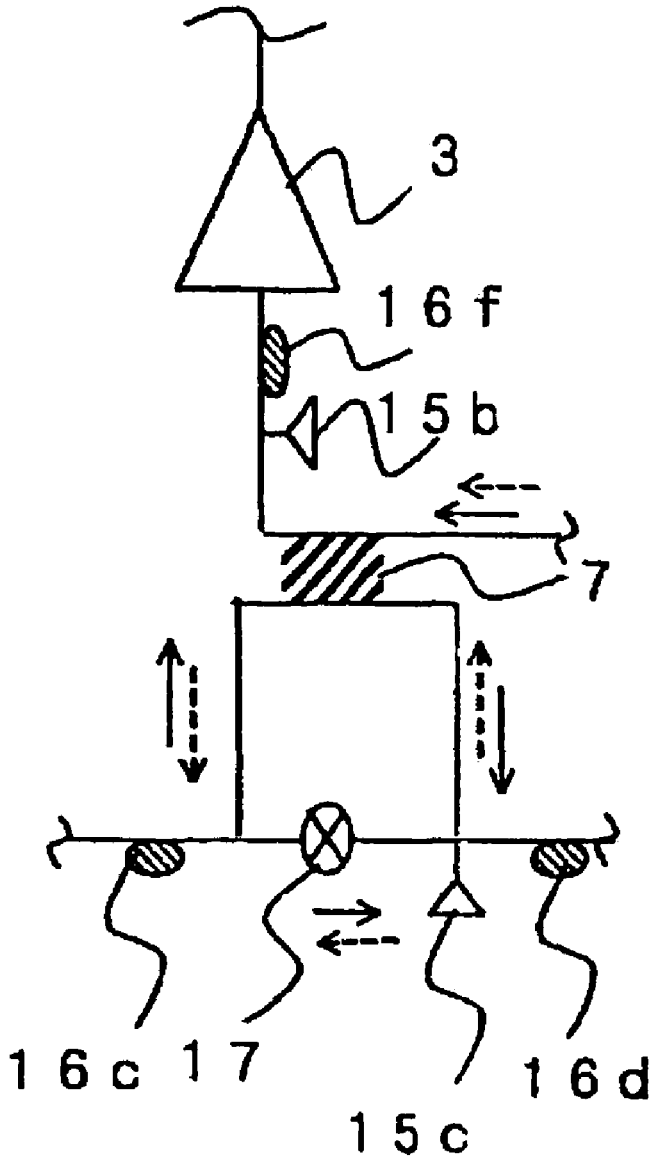
FIG. 11 is a refrigerant circuit diagram showing a temperature adjusting heat exchange unit according to a second embodiment of the invention.

The inner heat exchanger may be the one shown in FIG. 11, for example. FIG. 11 is a refrigerant circuit diagram showing part of the inner heat exchanger in the refrigeration cycle.

The high-low pressure heat exchanger 7 is constituted with a portion of the refrigerant pipe between the outdoor side expansion valve 6 and the indoor side expansion valve 9 obtained by partly branching as the high-pressure side, and the refrigerant pipe on the suction side of the compressor 3 as the low pressure side. The part of the high-pressure low-temperature refrigerant is branched and heat-exchanged with the low-pressure low-temperature refrigerant so as to become a low temperature, and is mixed with the high-pressure low-temperature refrigerant. By controlling the opening of the flow rate control valve 17 to increase or decrease the amount of refrigerant flowing into the high-low pressure heat exchanger 7, the temperature of the refrigerant passing through the indoor side expansion valve 9 can be controlled during the cooling operation, and the temperature of the refrigerant stored in the refrigerant storage container 12 can be controlled during the heating operation. By connecting the connecting portion of the refrigerant flowing out from the refrigerant storage container 12 through the flow rate control valve 13*c* to the upstream side of the high-low pressure heat exchanger 7 on the low-pressure side, even when the vapor-liquid two-phase refrigerant flows out from the refrigerant storage container 12 to the low-pressure side, it is heated by the high-low pressure heat exchanger 7 and is converted into refrigerant gas, so that liquid return to the compressor 3 can be prevented.

In general, when the outdoor side heat exchanger 5 and the indoor side heat exchanger 10 are both air cooling system, the internal capacity of the outdoor side heat exchanger 5 is larger than the internal capacity of the indoor side heat exchanger 10. Therefore, when comparing the cooling and heating operation, the amount of required refrigerant is larger during the cooling operation in which the capacity of the portion to be high-pressure is larger, and is smaller during the heating operation. Therefore, it is required to store a large amount of refrigerant in the refrigerant storage container 12 during the heating operation. The lower the temperature is, the larger the amount of refrigerant staying in the refrigerant pressure heat exchanger 7 becomes. Therefore, in the positional relation between the high-low pressure heat exchanger 7 and the branched portion toward the flow rate control valve 13*a* which supplies the high-pressure low-temperature, it is preferable that the high-low pressure heat exchanger 7 is positioned on the upstream side during heating operation as shown in FIG. 1, so that a large amount of refrigerant can be stored in the refrigerant storage container 12. In the case in which the outdoor side heat exchanger 5 is a water-cooled heat exchanger or the like and hence the interior capacity thereof is reduced to a level smaller than the interior capacity of the indoor side heat exchanger 10 during air cooling operation, the required amount of refrigerant is smaller during the cooling operation, and hence it is preferable to install the high-low pressure heat exchanger 7 on the upstream side of the branched portion to the flow rate control valve 13*a*.

When adjusting the amount of refrigerant in the refrigerant storage container 12, it is also possible to install the temperature sensor 16*l* for measuring the refrigerant temperature in the refrigerant storage container 12 or a pressure sensor for measuring the pressure, and control the openings of the flow rate control valves 13*a*, 13*b*, 13*c*, 14 so that the temperature or the pressure becomes the target value determined by the required amount of the refrigerant in the refrigerant storage container 12. For example, in the initial state when the system is activated or in the unstable state such that the operating conditions such as the number of operated indoor machines change significantly, the amount of refrigerant which is desired to be held in the refrigerant storage container 12 is determined in advance, a target temperature or a target pressure is set so as to realize this amount of refrigerant, and the opening of the flow rate control valve 13 is controlled. With such a control, the adjustment of the amount of refrigerant can be achieved adequately even under the state in which the feedback control by the high-pressure value or the radiator exit temperature cannot be performed sufficiently because of the unstable operation. Therefore, the operation of the refrigerating air conditioning system can be stabilized and the system with high reliability can be obtained.

Third Embodiment

It is also possible to perform adjustment of the amount of refrigerant to be filled in the system using the refrigerant amount control method of the refrigerating air conditioning system described in conjunction with the first embodiment and the second embodiment, at the time of test run performed in installation of the system. In this embodiment, the operation at the time of test run of the refrigerating air conditioning system will be described. The refrigerant circuit diagram of the refrigerating air conditioning system in this embodiment is the same as FIG. 1 and FIG. 10, and hence detailed description is omitted here.

Figure 12:
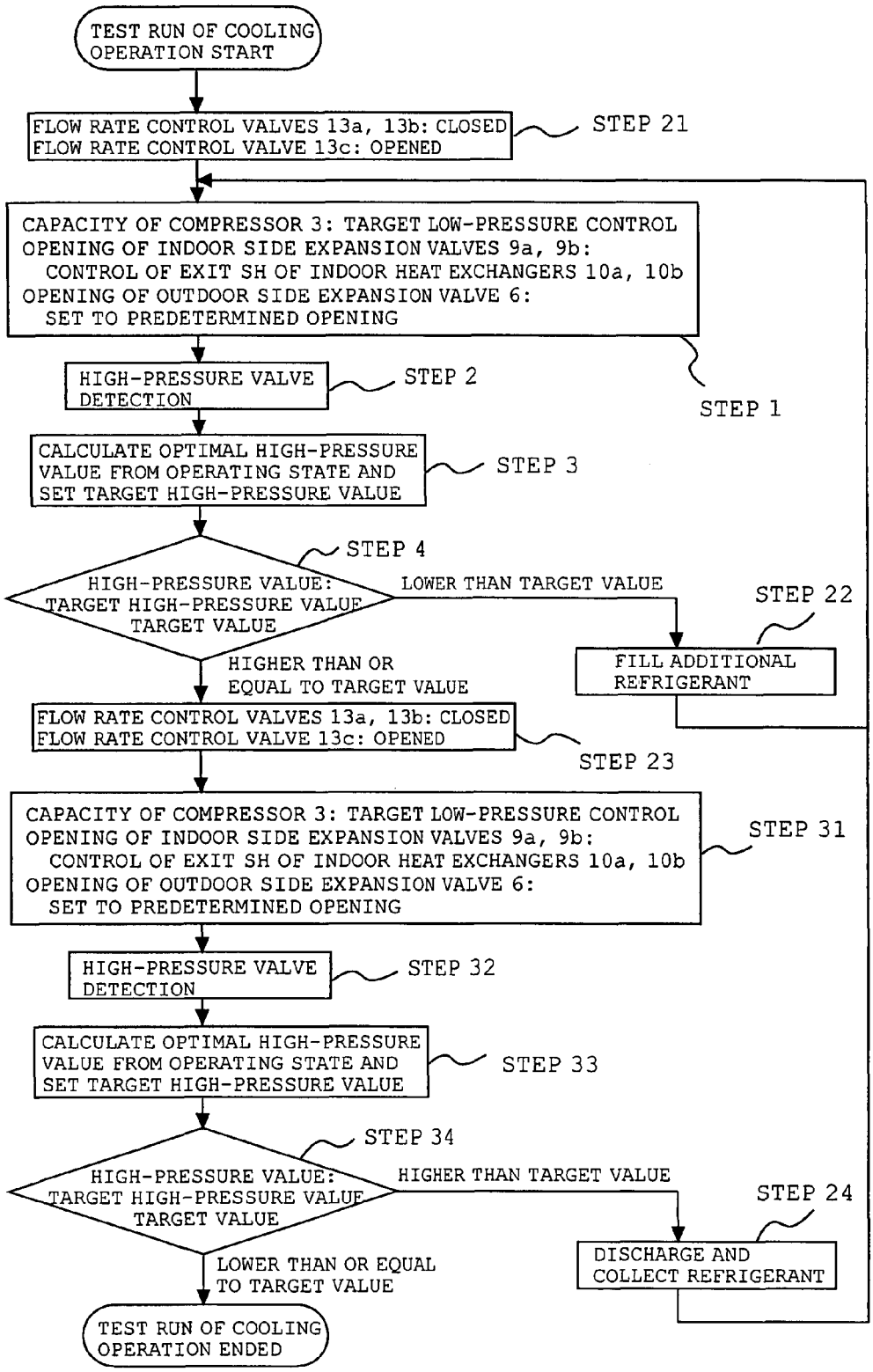
FIG. 12 is a flowchart showing a refrigerant amount adjusting action in a cooling test operation according to a third embodiment of the invention.

At the time of test run, one of the cooling operation or the heating operation is performed. For example, a case of performing the cooling operation will be described. FIG. 12 is a flowchart showing a procedure of the refrigerant amount adjusting method at the time of the test run of the refrigerating air conditioning system when performing the cooling operation. The flow rate control valves 13*a*, 13*b* are closed and the flow rate control valve 13*c* is opened so that the amount of refrigerant in the refrigerant storage container 12 becomes smallest (Step 21) and the test run of the cooling operation is performed in a state in which the amount of refrigerant circulating in the refrigeration cycle is maximum to determine whether the amount of filled refrigerant is deficient. The procedure of operation from Step 1 to Step 4 is the same as the action shown in FIG. 5. When the current high-pressure value is lower than the target high-pressure value in the comparison in step 4, the amount of refrigerant circulating in the refrigeration cycle is maximum, and the amount of refrigerant is deficient. Therefore, it is determined that the amount of filled refrigerant is deficient (the filled-refrigerant-amount deficiency determining step) and the refrigerant is additionally filled (Step 22). Then, additional filling of the refrigerant is performed until the current high-pressure value exceeds the target high-pressure value.

When the current high-pressure value exceeds the target high-pressure value, the determination of deficiency of the amount of filled refrigerant is ended, and the procedure goes to filled-refrigerant-amount excess determination. Here, the flow rate control valve 13*a* is opened, and the flow rate control valves 13*b*, 13*c* are closed so that the amount of refrigerant in the refrigerant storage container 12 becomes maximum (Step 23), and the test run of the cooling operation is performed in a state in which the amount of refrigerant circulating in the refrigeration cycle is minimum, to determine whether the amount of filled refrigerant is excessive or not. The actions from Step 31 to Step 34 are the same as in the operation from Step 1 to Step 4. When the current high-pressure value is higher than the target high-pressure value, the amount of refrigerant circulating in the refrigeration cycle is minimum, and hence the amount of refrigerant is excessive. Therefore, it is determined that the amount of filled refrigerant is excessive, and hence the discharge and collection of the refrigerant is performed (Step 24). Then, the procedure returns back to Step 1, and the procedure from the refrigerant-amount-deficiency determination is repeated again.

In the determination in Step 34, when the current high-pressure value is lower than or equal to the target high-pressure value, the high-pressure value can be controlled to be the target high-pressure value by adjusting the amount of refrigerant in the refrigerant storage container 12, that is, this state is a state in which the amount of refrigerant to be filled in the refrigerating air conditioning system is optimal.

In this manner, by determining excess or deficiency of the amount of refrigerant and adjusting the amount of refrigerant filled to the system to be an optimal amount at the time of the test run of the cooling operation, the amount of refrigerant existing in the heat exchanger which serves as the radiator can be controlled optimally also for normal operation of the system, and hence the operation in high efficiency is achieved.

In contrast with the procedure shown above, it is also possible to perform the test run of the cooling operation with the flow rate control valve 13*a* opened and the flow rate control valves 13*b*, 13*c* closed to determine whether the amount of filled refrigerant is excessive or not, then the test run of the cooling operation with the flow rate control valves 13*a*, 13*b* closed and the flow rate control valve 13*c* opened to determine whether the amount of filled refrigerant is deficient or not. In this case as well, the high-pressure value can be controlled to the target high-pressure value by adjusting the amount of refrigerant in the refrigerant storage container 12, so that the amount of refrigerant existing in the heat exchanger which serves as the radiator can be controlled optimally also for normal operation to achieve the operation in high-efficiency.

Although the test run of the refrigerating air conditioning system is performed by the cooling operation in the description shown above, the test run of the heating operation can be performed in the same manner. In this case as well, the test run of the heating operation is performed with the flow rate control valves 13*a*, 13*b* closed and the flow rate control valve 13*c* opened and whether the amount of filled refrigerant is deficient or not is determined. When the representative value of the radiator exit temperatures is higher than the target radiator exit temperature, the amount of filled refrigerant is deficient, and hence the refrigerant is additionally filled until the representative value of the radiator exit temperatures becomes lower than the target value. When the representative value of the radiator exit temperatures becomes lower than the target value, the test run of the heating operation is performed with the flow rate control valve 13*a* opened and the flow rate control valves 13*b*, 13*c* closed, and the procedure goes to the filled-refrigerant-amount excess determination. When the representative value of the radiator exit temperatures is lower than the target value, the amount of filled refrigerant is excessive, and hence the refrigerant is discharged and collected from the system and the procedure from the refrigerant-amount deficiency determination is repeated again. When the representative value of the radiator exit temperatures is equal to or higher than the target value, the representative temperature of the radiator exit temperature can be controlled to the target value by adjusting the amount of refrigerant in the refrigerant storage container 12, that is, this state is a state in which the amount of refrigerant to be filled in the refrigerating air conditioning system is optimal.

In this manner, by determining excess or deficiency of the amount of refrigerant and adjusting the amount of refrigerant filled in the system to an optimal amount at the time of test run of the heating operation, the amount of refrigerant existing in the heat exchanger which serves as the radiator can be controlled optimally also for normal operation of the system, and hence the operation in high efficiency is achieved.

In the heating operation, it is also possible to perform the refrigerant-amount excess determination first, and then perform the refrigerant-amount deficiency determination, and in this case as well, the same effect can be achieved.

In this manner, at the time of test run of the system, by the provision of a filled refrigerant amount deficiency determining step (Step 4) for determining whether the amount of filled refrigerant is deficient or not by operating in the high-pressure low-temperature refrigerant storing step for storing the high-pressure low-temperature refrigerant in the refrigerant storage container 12, and comparing the high-pressure value of the circulating refrigerant with the target high-pressure value or comparing the refrigerant temperature at the exit of the radiator with the target refrigerant temperature at the exit of the radiator, and a filled-refrigerant amount excess determining step (Step 34) for determining whether the amount of filled refrigerant is excessive by operating in the low-pressure low-temperature refrigerant storing step for storing the low-pressure low-temperature refrigerant in the refrigerant storage container 12, and comparing the high-pressure value of the circulating refrigerant with the target high-pressure value or comparing the refrigerant temperature at the exit of the radiator with the target refrigerant temperature at the exit of the radiator, the amount of refrigerant filled in the refrigerating air conditioning system can be adjusted optimally.

Incidentally, the operating state of the system for determining the excess or deficiency of the amount of refrigerant is not limited to that described above, and it may be determined using the radiator exit temperature at the time of cooling operation or may be determined using the high-pressure at the time of heating operation as described in the first embodiment.

In the refrigerating air conditioning system, the internal capacity of the outdoor side heat exchanger 5 is generally larger than the internal capacity of the entire indoor side heat exchangers 10. Therefore, the amount of refrigerant required is larger in the cooling operation in which the outdoor side heat exchanger 5 serves as the radiator. Therefore, the amount of refrigerant can be adjusted to be in an optimal range by determining whether the amount of filled refrigerant is deficient during the cooling operation and determining whether the amount of filled refrigerant is excessive during the heating operation.

The refrigerant amount adjusting method for the refrigerating air conditioning system as described above can be used not only at the time of test run, but also at the time for adjusting the amount of refrigerant during maintenance inspection.

The configurations shown in the first, second and third embodiments may be applied to a system in which only cold heat is supplied as the refrigeration device, for example, a system configuration including a condensing unit as the outdoor machine and a show case as the indoor machine. In this case, since the control of the cooling operation described above is performed, the four-way valve 4 and the outdoor side expansion valve 6 are not necessary.

The refrigerating air conditioning system in which the refrigeration cycle is configured with the outdoor machine 1 and the indoor machines 2 has been described in FIG. 1 and FIG. 10, the invention is not limited thereto. In the refrigerating air conditioning system separated into the outdoor machine 1 and the indoor machines 2, the refrigerant pipe between the outdoor machine 1 and the indoor machines 2 is long, and hence the amount of refrigerant to be filled therein is increased correspondingly. Therefore, the effects obtained by controlling the amount of refrigerant existing in the heat exchanger which serves as the radiator to a preferable amount in terms of the efficiency as described in conjunction with the first, second and third embodiments is significant. However, even when the invention is applied to the integrated refrigerating air conditioning system which is not separated into the indoor machine and the outdoor machine, there is an effect such that the operation in high efficiency can be achieved stably by controlling the amount of refrigerant existing in the radiator.

Although the system having the two indoor machines 2 has been described, the same effects can be obtained by performing the same control even in the case in which the system includes one indoor machine or three or more indoor machines. However, as described in particular in the first embodiment, in the refrigerating air conditioning system in which a plurality of the indoor machines 2 are connected, the respective indoor machines operate and stop according to the service conditions of the respective machines. Therefore, the amount of refrigerant existing in the heat exchanger which serves as the radiator can be adjusted to an adequate amount quickly by the refrigerant adjusting circuit 20 for the refrigerating air conditioning system in which the operation is liable to be unstable, and the amount of refrigerant required in the refrigeration cycle varies significantly, so that the improvement of the efficiency is achieved.

In the first, second and third embodiment, the same effects can be obtained irrespective of the form of the indoor machine 2 or the indoor side heat exchanger 10 and the form of the load side heat exchanging medium which exchanges heat with the refrigerant such as air or water.

The compressor 3 may be of any type such as scrolling type, rotary type, or reciprocating type, and the capacity control method may be of various methods such as controlling the number of compressors in the case when there are a plurality of compressors, or changing the injection, the refrigerant bypass between the high- and low-pressures or, the stroke volume in the case of a stroke-volume-variable type, in addition to the control of the number of revolution by the inverter.

The refrigerant in the description of the first, second and third embodiments is $CO_2$. By using $CO_2$, the refrigerating air conditioning can be performed using natural refrigerant which causes no problem in terms of global warming or destruction of the ozone layer, and the stabilization of operation is realized using the supercritical state which does not cause the change of phase in the high-pressure area. However, the refrigerant is not limited to $CO_2$, but the invention can be applied to those employing other refrigerants to be used in the supercritical area such as ethylene, ethane, or nitric oxide.

As described above, in the refrigerating air conditioning system including the outdoor machine having the compressor, the outdoor side heat exchanger, the outdoor side decompression device and the refrigerant amount adjusting circuit, and the plurality of indoor machines each having the indoor side heat exchanger and the indoor side decompression device, the refrigerating air conditioning system, in which the amount of refrigerant existing in the high-pressure side can be adjusted and hence the stable operation with high efficiency is achieved, can be obtained advantageously, by providing the control device, which controls the outdoor side decompression device so that the superheat at the exit of the outdoor side heat exchanger becomes a predetermined value and controls the operating state of the refrigerating air conditioning system to become a predetermined state by adjusting the amount of refrigerant existing in the indoor side heat exchangers by the refrigerant amount adjusting circuit in an operation mode, in which the compressor, the indoor side heat exchangers, the indoor side decompression devices, the outdoor side decompression device and the outdoor side heat exchanger are connected in an annular shape, in which the operation is performed with the high-pressure being higher than the critical pressure and the low-pressure being lower than the critical pressure, and in which the respective indoor side heat exchangers serve as the radiators and the outdoor side heat exchanger serves as the evaporator so that heat is supplied from the indoor side heat exchangers.

Also, the refrigerating air conditioning system, which can be operated in high efficiency while demonstrating a required capability in the operation to supply heat, can be obtained advantageously by providing the variable capacity compressor as the compressor, determining a target high-pressure value and a target value of the radiator exit temperature on the basis of the state of the load side which is supplied with heat, performing the capacity control of the compressor on the basis of the target high-pressure value and performing adjustment control of the amount of refrigerant on the basis of the target value of the radiator exit temperature.

Also, the refrigerating air conditioning system, which can be operated while keeping the state of the refrigerant stable, can be obtained advantageously by controlling the outdoor side decompression device and the respective indoor side decompression devices so that the state of the connecting pipe between the outdoor machine and the indoor machines for connecting the outdoor side decompression device and the indoor side decompression devices becomes the supercritical state.

Also, the refrigerating air conditioning system in which the operation can be controlled stably can be obtained advantageously by performing the control of the superheat at the exit of the outdoor side heat exchanger by the outdoor side decompression device at intervals shorter than the adjustment control of the amount of refrigerant existing in the indoor side heat exchangers by the refrigerant amount adjusting circuit.

Also, the refrigerating air conditioning system in which the operation can be controlled stably can be obtained advantageously by performing the capacity control of the compressor at intervals shorter than the adjustment control of the amount of refrigerant existing in the indoor side heat exchangers by the refrigerant amount adjusting circuit.

The refrigerating air conditioning system which can demonstrate the required capability reliably can be obtained advantageously by determining the flow resistances of the respective indoor side decompression devices according to the predetermined capacity of the respective indoor machines.

Also, the refrigerating air conditioning system, which can demonstrate the required capability reliably, can be obtained advantageously by controlling the respective indoor side decompression devices so that the refrigerant temperatures at the exits of the respective indoor side heat exchangers become target temperatures determined by the operating state of the outdoor machine.

Also, the refrigerating air conditioning system, which supplies the refrigerant in a good balance with the amount of heat exchange in the plurality of indoor side heat exchangers and can demonstrate the required capability reliably, can be obtained advantageously by controlling the respective indoor side decompression devices so that the temperatures at the exits of the respective indoor side heat exchangers fall within the predetermined temperature difference from the refrigerant temperature at the inlet port of the outdoor side decompression device.

Also, in the refrigerating air conditioning system including the outdoor machine having the compressor, the outdoor side heat exchanger, the outdoor side decompression device and the refrigerant amount adjusting circuit, and the plurality of indoor machines each having the indoor side heat exchanger and the indoor side decompression device, the refrigerating air conditioning system, which can be operated at high efficiency while demonstrating the required capability in the operation to supply cold heat, can be obtained advantageously by providing the control device, which controls the respective indoor side decompression devices so that the degrees of superheat at the exits of the respective indoor side heat exchangers become predetermined values and controls the operating state of the refrigerating air conditioning system to become a predetermined state by adjusting the amount of refrigerant existing in the outdoor side heat exchanger by the refrigerant amount adjusting circuit in an operation mode, in which the compressor, the outdoor side heat exchanger, the outdoor side decompression device, the indoor side decompression devices and the indoor side heat exchangers are connected in an annular shape, in which the operation is performed with the high-pressure being higher than the critical pressure and the low-pressure being lower than the critical pressure, and in which the outdoor side heat exchanger serves as the radiators and the respective indoor side heat exchangers serve as the evaporator so that cold heat is supplied from the indoor side heat exchangers.

Also the refrigerating air conditioning system, which can be operated while keeping the state of the refrigerant stable, can advantageously obtained by controlling the outdoor side decompression device so that the state of the connecting pipe between the outdoor machine and the indoor machines for connecting the outdoor side decompression device and the indoor side decompression devices becomes the supercritical state.

Also the refrigerating air conditioning system, which can be operated while keeping the state of the refrigerant stable, can be obtained advantageously by performing the adjustment control of the amount of refrigerant existing in the outdoor side heat exchanger by the refrigerant amount adjusting circuit so that the high-pressure or the refrigerant temperature at the exit of the outdoor side heat exchanger becomes a predetermined state.

Also the refrigerating air conditioning system, which can demonstrate a required capability reliably, can be obtained advantageously by providing a variable capacity compressor as the compressor and performing the capacity control of the compressor so that the low-pressure becomes the predetermined state.

Also the refrigerating air conditioning system, which can demonstrate a required capability reliably, can be obtained advantageously by providing a variable capacity compressor as the compressor and performing the capacity control of the compressor according to the cooling state of the load side to which cold heat is supplied.

Also, the refrigerating air conditioning system, in which the operation can be controlled stably, can be obtained advantageously by performing the control of the degrees of superheat at the exits of the respective indoor side heat exchangers by the indoor side decompression devices at intervals shorter than the adjustment control of the amount of refrigerant existing in the outdoor side heat exchanger by the refrigerant amount adjusting circuit.

Also the refrigerating air conditioning system, in which the operation can be controlled stably, can be obtained advantageously by performing the capacity control of the compressor at intervals shorter than the adjustment control of the amount of refrigerant existing in the outdoor side heat exchanger by the refrigerant amount adjusting circuit.

Also, in the refrigerating air conditioning system including the outdoor machine including the compressor, the four-way valve, the outdoor side heat exchanger, the outdoor side decompression device and the refrigerant amount adjusting circuit, and the plurality of indoor machines each having the indoor side heat exchanger and the indoor side decompression device, the refrigerating air conditioning system, which can be operated in both operation modes of an operation mode in which heat is supplied from the indoor side heat exchangers and an operation mode in which cold heat is supplied, and can be operated stably in highly efficient state even with the plurality of indoor machines, can be obtained advantageously by realizing, by switching the flow-path by the four-way valve, an operation mode, in which the compressor, the outdoor side heat exchanger, the outdoor side decompression device, the indoor side decompression devices and the indoor side heat exchangers are connected in an annular shape, the operation is performed with the high-pressure being higher than the critical pressure and the low-pressure being lower than the critical pressure, and the outdoor side heat exchanger serves as the radiator and the respective indoor side heat exchangers serve as the evaporators so that the cold heat is supplied from the indoor side heat exchangers, and an operation mode in which the compressor, the indoor side heat exchangers, the indoor side decompression devices, the outdoor side decompression device, and the outdoor side heat exchanger are connected in an annular shape, the operation is performed with the high-pressure being higher than the critical pressure and the low-pressure being lower than the critical pressure, and the respective indoor side heat exchangers serve as the radiators and the outdoor side heat exchanger serves as the evaporator so that heat is supplied from the indoor side heat exchangers; controlling the state of the refrigerant between the outdoor side decompression device and the indoor side decompression devices to be the supercritical state by the both decompression devices and the superheat at the exit of the heat exchanger which serves as the evaporator to be a predetermined value in the both operation modes; and providing the refrigerant amount adjusting circuits including the refrigerant storage container, a connecting circuit for connecting the refrigerant storage container with the refrigerant flow path between the outdoor side decompression device and the indoor side decompression devices, and a connecting circuit for connecting at least one of the discharge side of the compressor and the suction side of the compressor.

The refrigerating air conditioning system which can be operated in high efficiency in the refrigeration cycle via the supercritical state can be obtained advantageously by using carbon dioxide as the refrigerant.

DESCRIPTION OF REFERENCE NUMERALS

1 outdoor machine
2*a*, 2*b* indoor machine
3 compressor
4 flow path switching valve
5 heat source side heat exchanger
6 heat source side decompression device
7 temperature adjusting heat exchange unit
9*a*, 9*b* user side decompression device
10*a*, 10*b* user side heat exchanger
12 refrigerant storage container
13*a*, 13*b*, 13*c* flow rate control valve
14 flow rate control valve
15*a*, 15*b*, 15*c* pressure sensor
16*a* 16*b*, 16*c*, 16*d*, 16*e*, 16*f*, 16*g*, 16*h*, 16*i*, 16*j*, 16*k*, 16*l* temperature sensor
17 measurement control device
18 connecting pipe
20 refrigerant amount adjusting circuit
31 compressor controlling means
32 superheat controlling means
33 decompression device controlling means
34 target value setting means
35 refrigerant amount controlling means

The invention claimed is:

1. A refrigerating air conditioning system comprising:

a refrigeration cycle configured to circulate refrigerant through a compressor, a user side heat exchanger, a user side decompression device, a heat source side decompression device and a heat source side heat exchanger and operated with a high-pressure value being a pressure higher than a critical pressure of the refrigerant and a low-pressure value being a pressure lower than the critical pressure;

a refrigerant amount adjusting circuit including, a refrigerant storage container, a high-pressure low-temperature refrigerant connecting pipe for connecting and disconnecting the refrigerant pipe between the heat source side decompression device and the user side decompression device and the refrigerant storage container, a low-pressure low-temperature refrigerant connecting pipe for connecting and disconnecting the refrigerant storage container and a suction side of the compressor, and a high-pressure high-temperature refrigerant connecting pipe for connecting and disconnecting the refrigerant storage container and a discharge side of the compressor, wherein the refrigerant amount adjusting circuit can increase and decrease the amount of refrigerant existing in the refrigeration cycle;

superheat controlling means for controlling the heat source side decompression device so that the degree of superheat at an exit of the heat source side heat exchanger becomes a predetermined value during a heat utilizing operation in which heat is supplied by the user side heat exchanger;

refrigerant amount controlling means for changing the amount of refrigerant in the refrigerant storage container which adjusts the amount of refrigerant existing in the user side heat exchanger, so that the temperature or the pressure of the refrigerant at an exit of the user side heat exchanger becomes a predetermined state by, during the heat utilizing operation, when a high-pressure value of the refrigeration cycle is smaller than a high-pressure target value or an exit refrigerant temperature of the user side heat exchanger is larger than an exit refrigerant target temperature, cutting off the high-pressure low-temperature refrigerant connecting pipe and connecting the high-pressure high-temperature refrigerant connecting pipe or the low-pressure low-temperature refrigerant connecting pipe, so that a small-density refrigerant is stored in the refrigerant storage container, and when the high-pressure value of the refrigeration cycle is larger than the high-pressure target value or the exit refrigerant temperature of the user side heat exchanger is smaller than the exit refrigerant target temperature, connecting the high-pressure low-temperature refrigerant connecting pipe or the high-pressure high-temperature connecting pipe and cutting off the low-pressure low-temperature refrigerant connecting pipe, so that a large-density refrigerant is stored in the refrigerant storage container; and decompression device controlling means for controlling the user side decompression device so that the state of the refrigerant in a pipe that connects the heat source side decompression device and the user side decompression device becomes a supercritical state.

2. The refrigerating air conditioning system according to claim 1, comprising compressor controlling means for controlling a capacity of the compressor, and target setting means for setting a target high-pressure value and a target value of the refrigerant temperature at the exit of the user side heat exchanger, so as to obtain an amount of heat required in the user side heat exchanger, wherein the refrigerant amount controlling means and the compressor controlling means controls the high-pressure value of the refrigeration cycle to be the high-pressure target value and controls the refrigerant temperature at the exit of the user side heat exchanger to be the target value of the refrigerant temperature at the exit.

3. The refrigerating air conditioning system according to claim 2, wherein the compressor controlling means controls the capacity of the compressor so that the high-pressure value of the refrigeration cycle becomes the target high-pressure value, and the refrigerant amount controlling means controls the refrigerant amount adjusting circuit so that the refrigerant temperature at the exit of the user side heat exchanger becomes the target value of refrigerant temperature at the exit.

4. The refrigerating air conditioning system according to claim 1, comprising a plurality of indoor machines each having a user side heat exchanger and the user side decompression device.

5. The refrigerating air conditioning system according to claim 4, wherein the decompression device controlling means adjusts the flow resistances of each user side decompression device according to a predetermined capacity of the corresponding user side heat exchanger.

6. The refrigerating air conditioning system according to claim 4, wherein the decompression device controlling means adjusts the flow resistance of each user side decompression devices so that the refrigerant temperature at the exit of the corresponding user side heat exchangers or a representative refrigerant temperature which represents these refrigerant temperatures becomes a target value of the refrigerant temperature at the exit which is determined by the operating state of the refrigeration cycle.

7. The refrigerating air conditioning system according to claim 6, wherein the decompression device controlling means adjusts the flow resistance of each user side decompression device so that the refrigerant temperature at the exit of the corresponding user side heat exchanger fall within a predetermined temperature difference from the refrigerant temperature at the inlet port of the heat source side decompression device.

8. A refrigerating air conditioning system comprising:

a refrigeration cycle configured to circulate refrigerant through a compressor, a heat source side heat exchanger, a heat source side decompression device, a user side decompression device and a user side heat exchanger and operated with a high-pressure value being a pressure higher than a critical pressure of the refrigerant and a low-pressure value being a pressure lower than the critical pressure;

a refrigerant amount adjusting circuit including, a refrigerant storage container, a high-pressure low-temperature refrigerant connecting pipe for connecting and disconnecting the refrigerant pipe between the heat source side decompression device and the user side decompression device and the refrigerant storage container, a low-pressure low-temperature refrigerant connecting pipe for connecting and disconnecting the refrigerant storage container and a suction side of the compressor, and a high-pressure high-temperature refrigerant connecting pipe for connecting and disconnecting the refrigerant storage container and a discharge side of the compressor, wherein the refrigerant amount adjusting circuit can increase and decrease the amount of refrigerant existing in the refrigeration cycle;

superheat controlling means for controlling the user side decompression device so that the degree of superheat at an exit of the user side heat exchanger becomes a predetermined value during a cold heat utilizing operation in which cold heat is supplied by the user side heat exchanger;

refrigerant amount controlling means for changing the amount of refrigerant in the refrigerant storage container which adjusts the amount of refrigerant existing in the heat source side heat exchanger so that the temperature or the pressure of the refrigerant at the exit of the heat source side heat exchanger becomes a predetermined state by, during the heat utilizing operation, when a high-pressure value of the refrigeration cycle is smaller than a high-pressure target value or an exit refrigerant temperature of the heat source side heat exchanger is larger than an exit refrigerant target temperature, cutting off the high-pressure low-temperature refrigerant connecting pipe and connecting the high-pressure high-temperature refrigerant connecting pipe or the low-pressure low-temperature refrigerant connecting pipe, so that a small-density refrigerant is stored in the refrigerant storage container, and when the high-pressure value of the refrigeration cycle is larger than the high-pressure target value or the exit refrigerant temperature of the heat source side heat exchanger is smaller than the exit refrigerant target temperature, connecting the high-pressure low-temperature refrigerant connecting pipe or the high-pressure high-temperature connecting pipe and cutting off the low-pressure low-temperature refrigerant connecting pipe, so that a large-density refrigerant is stored in the refrigerant storage container; and decompression device controlling means for controlling the heat source side decompression device so that the state of the refrigerant in a pipe that connects the heat source side decompression device and the user side decompression devices becomes a supercritical state.

9. The refrigerating air conditioning system according to claim 8, comprising target value setting means for setting a target high-pressure value or a target value of the refrigerant temperature at the exit of the heat source side heat exchanger, wherein the refrigerant amount controlling means controls the refrigerant amount adjusting circuit so as to satisfy at least one of the target values.

10. The refrigerating air conditioning system according to claim 8, wherein the compressor is a variable capacity compressor and compressor controlling means controls the capacity of the compressor so that the low-pressure value of the refrigeration cycle becomes a predetermined value.

11. The refrigerating air conditioning system according to claim 8, wherein the compressor is a variable capacity compressor and compressor controlling means controls the capacity of the compressor so that an amount of cold heat required in the user side heat exchangers can be obtained.

12. A refrigerating air conditioning system comprising:

a refrigeration cycle for circulating refrigerant through a compressor, a heat source side heat exchanger, a heat source side decompression device, a user side decompression device, and a user side heat exchanger which are connected with a refrigerant pipe, and operating with a high-pressure value being a pressure higher than a critical pressure of the refrigerant and a low-pressure value being a pressure lower than the critical pressure;

a refrigerant amount adjusting circuit including, a refrigerant storage container, a high-pressure low-temperature refrigerant connecting pipe which can connect and disconnect the refrigerant pipe between the heat source side decompression device and the user side decompression device and the refrigerant storage container, a low-pressure low-temperature refrigerant connecting pipe which can connect and disconnect the refrigerant storage container and a suction side of the compressor, and a high-pressure high-temperature refrigerant connecting pipe which can connect and disconnect the refrigerant storage container and a discharge side of the compressor, wherein the refrigerant amount adjusting circuit can increase and decrease the amount of refrigerant existing in the refrigeration cycle;

a heat utilizing operation mode in which the refrigerant is circulated through the compressor, the user side heat exchanger, the user side decompression device, the heat source side decompression device, and the heat source side heat exchanger in order, and the user side heat exchanger is operated as a radiator and the heat source side heat exchanger is operated as an evaporator;

a cold heat utilizing mode in which the refrigerant is circulated through the compressor, the heat source side heat exchanger, the heat source side decompression device, the user side decompression device and the user side heat exchanger in order, and the user side heat exchanger is operated as an evaporator and the heat source side heat exchanger is operated as a radiator;

a flow path switching valve for switching the flow of the refrigerant between the heat utilizing operation mode and the cold heat utilizing operation mode;

superheat controlling means for controlling the decompression device disposed on the upstream side of the heat exchanger which serves as the evaporator so that the superheat at the exit of the heat exchanger which serves as the evaporator becomes a predetermined value when being operated in the heat utilizing operation mode and the cold heat utilizing operation mode;

and refrigerant amount controlling means for changing the amount of refrigerant in the refrigerant storage container which adjusts the amount of refrigerant existing in the heat exchanger which serves as the radiator to control the temperature or the pressure of the refrigerant at the exit of the heat exchanger which serves as a radiator to become a predetermined state, by, when a high-pressure value of the refrigeration cycle is smaller than a high-pressure target value or an exit refrigerant temperature of the heat exchanger which serves as a radiator is larger than an exit refrigerant target temperature, cutting off the high-pressure low-temperature refrigerant connecting pipe and connecting the high-pressure high-temperature refrigerant connecting pipe or the a low-pressure low-temperature refrigerant connecting pipe, so that a small-density refrigerant is stored in the refrigerant storage container, and when the high-pressure value of the refrigeration cycle is larger than the high-pressure target value or the exit refrigerant temperature of the heat exchanger which serves as a radiator is smaller than the exit refrigerant target temperature, connecting the high-pressure low-temperature refrigerant connecting pipe or the high-pressure high-temperature refrigerant connecting pipe and cutting off the low-pressure low-temperature refrigerant connecting pipe to change the refrigerant amount in the refrigerant storage container, so that a large-density refrigerant is stored in the refrigerant storage container; and decompression device controlling means for controlling each heat source side decompression device and user side decompression device so that the state of the refrigerant in a pipe that connects the heat source side decompression device and the user side decompression device becomes a supercritical state.

13. The refrigerating air conditioning system according to claim 8, comprising a plurality of the indoor machines each having the user side heat exchanger and the user side decompression device.

14. The refrigerating air conditioning system according to claim 1, comprising a temperature adjusting heat exchange unit for adjusting the temperature of the refrigerant flowing in the pipe which connects the user side decompression device and the heat source side decompression device.

15. The refrigerating air conditioning system according to claim 14, wherein the temperature adjusting heat exchange unit is provided on the upstream side of a connecting portion between the refrigeration cycle refrigerant pipe and the refrigerant amount adjusting circuit, and heat is exchanged between refrigerant flowing on the upstream side of the connecting portion and low-pressure refrigerant obtained by branching and decompressing part of the refrigerant flowing on the upstream side, thereby adjusting the temperature of the refrigerant flowing at the connecting portion.

16. The refrigerating air conditioning system according to claim 1, wherein the compressor, the heat source side decompression device, the heat source side heat exchanger and the refrigerant storage container are stored in an outdoor machine, the user side heat exchangers and the user side decompression devices are stored in the indoor machines, and the indoor machines and the outdoor machine are connected by the refrigerant pipes.

17. The refrigerating air conditioning system according to claim 1, wherein carbon dioxide is used as the refrigerant.

18. A method of controlling the operation of a refrigerating air conditioning system comprising:

a refrigeration cycle configured by circulating refrigerant through a compressor, a radiator, a user side decompression device, a heat source side decompression device, and an evaporator;

a refrigerant amount adjusting circuit including, a refrigerant storage container, a high-pressure low-temperature refrigerant connecting pipe for connecting and disconnecting the refrigerant pipe between the heat source side decompression device and the user side decompression device and the refrigerant storage container, a low-pressure low-temperature refrigerant connecting pipe for connecting and disconnecting the refrigerant storage container and a suction side of the compressor, and a high-pressure high-temperature refrigerant connecting pipe for connecting and disconnecting the refrigerant storage container and a discharge side of the compressor, wherein the refrigerant amount adjusting circuit can increase and decrease the amount of refrigerant existing in the refrigeration cycle;

a refrigeration air conditioning step for performing an operation with the high pressure side of the refrigeration cycle being a critical pressure or more and the low pressure side of the refrigeration cycle being the critical pressure or less to perform refrigeration air conditioning in the evaporator or the radiator;

a superheat controlling step for controlling a decompression device disposed at the upstream side of the evaporator so that the superheat at the exit of the evaporator is a predetermined value;

a refrigerant amount controlling step for changing the amount of refrigerant in the refrigerant storage container which adjusts the amount of refrigerant existing in the heat exchanger which serves as a radiator so that the temperature or the pressure of the refrigerant at the exit of the heat exchanger which serves as a radiator becomes a state of the target value by, when a high-pressure value of the refrigeration cycle is smaller than a high-pressure target value or an exit refrigerant temperature of the heat exchanger which serves as a radiator is larger than an exit refrigerant target temperature, cutting off the high-pressure low-temperature refrigerant connecting pipe and connecting the high-pressure high-temperature refrigerant connecting pipe or the low-pressure low-temperature connecting pipe, so that a small-density refrigerant is stored in the refrigerant storage container, and when the high-pressure value of the refrigeration cycle is larger than the high-pressure target value or the exit refrigerant temperature of the heat exchanger which serves as a radiator is smaller than the exit refrigerant target temperature, connecting the high-pressure low-temperature refrigerant connecting pipe or the high-pressure high-temperature connecting pipe and cutting off the low-pressure low-temperature refrigerant connecting pipe, so that a large-density refrigerant is stored in the refrigerant storage container; and a decompression device controlling step for controlling each of the heat source side decompression device and the user side decompression device so that the state of the refrigerant in a pipe that connects the heat source side decompression device and the user side decompression device becomes a supercritical state.

19. The method of controlling the operation of a refrigerating air conditioning system according to claim 18, wherein intervals of the superheat control performed at the exit of the evaporator in the superheat controlling step are shorter than intervals of the refrigerant amount adjusting control performed in the refrigerant amount controlling step.

20. The method of controlling the operation of a refrigerating air conditioning system according to claim 18, comprising a target setting step for setting a high-pressure target and a target value of the refrigerant temperature at the radiator exit for obtaining an amount of heat required in the radiator, and a compressor controlling step for controlling the capacity of the compressor so that the high-pressure value of the circulating refrigerant becomes the target high pressure value, wherein the refrigerant amount controlling step is to adjust the amount of refrigerant so that the temperature of the circulating refrigerant at the radiator exit becomes the target value of the refrigerant temperature at the radiator exit so as to supply heat from the radiator for use.

21. The method of controlling the operation of a refrigerating air conditioning system according to claim 18, comprising a target setting step for setting a target high-pressure value, wherein the refrigerant amount controlling step is to adjust the amount of refrigerant so that the high-pressure value of the circulating refrigerant becomes the high-pressure target value so as to supply cold heat from the evaporator for use.

22. The method of controlling the operation of a refrigerating air conditioning system according to claim 21, comprising a compressor controlling step for controlling the capacity of the compressor so that the low-pressure value of the circulating refrigerant becomes a predetermined value.

23. The method of controlling the operation of a refrigerating air conditioning system according to claim 21, comprising a compressor controlling step for controlling the capacity of the compressor so that an amount of cold heat required in the evaporator can be obtained.

24. The method of controlling the operation of a refrigerating air conditioning system according to claim 20, wherein intervals of the capacity control of the compressor performed in the compressor controlling step are shorter than intervals of the refrigerant amount adjusting control performed in the refrigerant amount controlling step.

* * * * *